US011624585B2

(12) United States Patent
Galli et al.

(10) Patent No.: US 11,624,585 B2
(45) Date of Patent: Apr. 11, 2023

(54) ELECTRONIC WEAPON ACCESSORY AND DETACHABLE MOUNT WITH INTEGRATED CONTROL APPARATUS

(71) Applicant: Emissive Energy Corp., North Kingstown, RI (US)

(72) Inventors: Robert D. Galli, North Kingstown, RI (US); Christopher J. O'Brien, North Kingstown, RI (US); Mikhail T. Hyde, North Kingstown, RI (US)

(73) Assignee: Emissive Energy Corp., North Kingstown, RI (US)

( * ) Notice: Subject to any disclaimer, the term of this patent is extended or adjusted under 35 U.S.C. 154(b) by 0 days.

(21) Appl. No.: 17/360,168

(22) Filed: Jun. 28, 2021

(65) Prior Publication Data

US 2021/0341258 A1 Nov. 4, 2021

Related U.S. Application Data

(63) Continuation of application No. 16/458,776, filed on Jul. 1, 2019, now Pat. No. 11,067,363, which is a continuation-in-part of application No. 16/210,838, filed on Dec. 5, 2018, now Pat. No. 10,634,455, which is a continuation-in-part of application No. 15/607,451, filed on May 27, 2017, now Pat. No. 10,151,564.

(Continued)

(51) Int. Cl.

| | |
|---|---|
| ***F41G 1/35*** | (2006.01) |
| ***F41G 11/00*** | (2006.01) |
| ***H05B 45/00*** | (2022.01) |

(52) U.S. Cl.

CPC ..... *F41G 1/35* (2013.01); *F41G 11/003* (2013.01); *H05B 45/00* (2020.01)

(58) Field of Classification Search

CPC ..... F41G 1/35; F41G 11/003

See application file for complete search history.

(56) References Cited

U.S. PATENT DOCUMENTS

| | | | |
|---|---|---|---|
| 5,584,137 | A | 12/1996 | Teetzel |
| 6,622,416 | B2 | 9/2003 | Kim |

(Continued)

*Primary Examiner* — Joshua T Semick

(74) *Attorney, Agent, or Firm* — Barlow Josephs and Holmes Ltd

(57) ABSTRACT

An electronic weapon accessory system includes an electronic weapon accessory, such as a light, and a detachable mount with an integrated control switch. The electronic weapon accessory includes an electronic component, such as an LED, and a power source disposed within a housing. The electronic component and the battery are electrically connected with a circuit having electrical contacts exposed on an outer surface of the housing. The mount has a body with a clamp structure, a dome switch disposed on an outer surface of the mount body and a circuit having electrical contacts exposed on the outer surface of the mount body. Fasteners removably secure the mount body and accessory housing in assembled relation. When the electronic weapon accessory and mount are assembled, the accessory electrical contacts physically and electrically engaging the mount electrical contacts to complete an electronic control circuit and provide integrated control and operation of the electronic accessory.

11 Claims, 30 Drawing Sheets

Related U.S. Application Data

(60) Provisional application No. 62/342,430, filed on May 27, 2016.

(56) References Cited

U.S. PATENT DOCUMENTS

| | | | | |
|---|---|---|---|---|
| 7,332,682 | B2 | 2/2008 | Kim | |
| 7,581,848 | B1 | 9/2009 | Parsons et al. | |
| 7,685,759 | B2 * | 3/2010 | Teetzel | F41G 11/003 42/127 |
| 7,866,083 | B2 | 1/2011 | Teetzel | |
| 8,220,946 | B1 | 7/2012 | Teetzel | |
| 8,448,368 | B2 | 5/2013 | Cabahug et al. | |
| 8,607,492 | B2 | 12/2013 | Hartley et al. | |
| 8,727,556 | B2 | 5/2014 | Swan | |
| 8,800,194 | B2 * | 8/2014 | Teetzel | F41G 11/003 42/124 |
| 8,944,626 | B2 | 2/2015 | Matthews et al. | |
| 9,506,723 | B2 | 11/2016 | Teetzel et al. | |
| 9,562,550 | B2 | 2/2017 | Swan et al. | |
| 10,151,564 | B2 | 12/2018 | Galli | |
| 10,184,756 | B1 | 1/2019 | McCauley et al. | |
| 10,415,932 | B1 | 9/2019 | Greenslade et al. | |
| 10,634,455 | B2 | 4/2020 | Galli et al. | |
| 10,641,583 | B2 * | 5/2020 | Zimmer | F41G 11/003 |
| 2007/0227056 | A1 | 10/2007 | Howe et al. | |
| 2008/0164392 | A1 | 7/2008 | Holmberg | |
| 2009/0101776 | A1 | 4/2009 | Peterson et al. | |
| 2011/0162251 | A1 | 7/2011 | Houde-Walter | |
| 2013/0061504 | A1 | 3/2013 | Malherbe et al. | |
| 2014/0063791 | A1 | 3/2014 | Frazier | |
| 2014/0092588 | A1 | 4/2014 | Toman et al. | |
| 2015/0159847 | A1 | 6/2015 | Galli et al. | |
| 2015/0316355 | A1 | 11/2015 | Boswell | |
| 2016/0341521 | A1 | 11/2016 | Bigby et al. | |
| 2017/0343319 | A1 | 11/2017 | Galli | |

* cited by examiner

ELECTRONIC WEAPON ACCESSORY AND DETACHABLE MOUNT WITH INTEGRATED CONTROL APPARATUS

CROSS REFERENCE TO RELATED APPLICATIONS

This Application is a continuation of U.S. application Ser. No. 16/458,776, filed Jul. 1, 2019, which is a continuation-in-part of U.S. application Ser. No. 16/210,838, filed Dec. 5, 2018, now U.S. Pat. No. 10,634,455, issued Apr. 28, 2020, which is a continuation-in-part of U.S. application Ser. No. 15/607,451, filed May 27, 2017, now U.S. Pat. No. 10,151,564, issued Dec. 11, 2018, which is a non-provisional of, and claims the benefit, of U.S. Provisional Patent Application No. 62/342,430, filed May 27, 2016, the entire contents of which are incorporated herein by reference.

BACKGROUND OF THE DISCLOSURE (1) Field of the Disclosure: The instant disclosure relates to electronic weapon accessories for commercial and combat weapons.

(2) Description of Related Art: As the field of commercial and combat weaponry expands, numerous add-on accessories have become available and are commonly mounted on various firearms. In order to mount these accessories, most weapons now include, or are modified to include, one or more MIL-STD 1913 dovetail attachment rails. Many of the semi-automatic rifle systems include rail systems having four separate rails surrounding the barrel for maximum mounting surface area. The accessories are typically mounted to the dovetail rails using interface mounts where one face of the mount secures to the accessory and the other face secures to the dovetail rail with a clamp. Many varieties of clamping arrangements are known in the art.

As is well known in this art, user configurable mounting arrangements are highly desirable as there are many different types of accessories and many different preferences for their mounting and operation. Sighting accessories are typically mounted on an upper rail. However, electronic accessories, such as flashlights, IR illuminators and lasers can be mounted in many different locations around the barrel. The ability of the user to mount an electronic accessory in a particular location on a weapon with a particular presentation of the controls is paramount to ease of use, user effectiveness and most importantly, user safety. Customization is critical to every soldier, law enforcement officer and civilian weapon owner.

SUMMARY OF THE DISCLOSURE

The present disclosure relates to an electronic weapon accessory, such as a flashlight, and a detachable mount for the accessory which both have mating electrical contacts at the mechanical interface between the two components. The detachable mount includes integrated control apparatus that is external to the accessory. The detachable mount can be removed, and/or reversed to provide a variety of mounting and control configurations or can be entirely replaced with a differently shaped or configured mount with a different control interface.

More specifically, an electronic weapon accessory system includes an electronic weapon accessory, such as a light, and a detachable mount with integrated controls. The electronic weapon accessory includes an electronic component, such as an LED, and a power source disposed within a housing. The accessory may comprise any electronic device mountable on a weapon platform, including LED lights, IR illuminators, lasers, range finders, etc. and in this regard, the accessory may further include a processor for control of the accessory. The electronic component, the processor and the battery are electrically connected with a circuit having electrical contacts exposed on an outer surface or raised platform surface of the housing. The contacts may comprise contact pads, pins, spring pins, pogo pins, etc. One exemplary embodiment includes concentric contact pads which are molded into the plastic housing of the electronic accessory. Other configurations are contemplated.

The mount has a body with a dovetail rail clamp, a switch disposed on an outer surface of the mount body and a circuit electrically connected with the switch having electrical contacts exposed on the outer surface of the mount body.

The exemplary embodiment of the dovetail rail clamp includes a fixed clamp edge on the mount body and a movable clamp element secured with a thumb screw. Other rail and clamping arrangements, such as the Magpul M-Lok system, are contemplated (Magpul and M-Lok are trademarks of Magpul Industries, Inc.).

In some embodiments, the mount body may include a first linear portion and a second angled portion, and the switch may be located on the angled portion. This configuration allows the mount body to closely conform to the outer shape of a conventional cylindrical or octagonal rifle handguard, and places the switch at an optimal ergonomic position for the thumb while gripping the handguard.

The accessory housing and the mount body include interfitting mating formations which are received together in interfitting mating relation for alignment of the mount with the accessory housing. The formations are preferably configured so that they are reversible or adjustable to provide alternate orientations. For example, paired formations along an axis of the mount allow the mount to be reversibly configured for left or right hand mounting, or upper and lower mounting depending on the desired mounting location on the dovetail rail. Other formations may provide additional mounting orientations. Fasteners removably secure the mount body and accessory housing in assembled relation. Preferably, the fasteners are adjacent the mating formations and may pass through the formations.

Another exemplary embodiment includes a mating platform raised off the outer surface of the housing to provide additional housing wall thickness for spring loaded contact pins (pogo pins).

The exemplary embodiments may further include a waterproofing gasket(s) surrounding the electrical contacts which is received in complementary gasket channels surrounding the contacts on both the accessory housing and the mount.

When the electronic weapon accessory and mount are secured in assembled relation, the accessory electrical contacts physically and electrically engage the mount electrical contacts to provide a completed electronic control circuit and provide integrated control and operation of the electronic accessory with the switch on the mount.

The mount may further include additional switches for more sophisticated electronic accessories requiring multiple controls, and may in some embodiments further include a separate processor to provides additional switching and control functionality using one or more switches. In some embodiments, the additional switch may be a slide switch on the body of the accessory or a lever switch on the mount body.

The novel concept surrounding the invention is the removal of the mounting and control aspects of an electronic weapon accessory from the main housing of the accessory and the ability to separately adapt and customize both the mounting configuration as well as the control interface for the accessory. As indicated above, the mount and accessory are configured for reversible mounting so that the accessory can be adapted and mounted on either of the side dovetail rails of a conventional rail system or on the top or bottom rail. The exemplary embodiment locates the switch on the major outward flat face of the mount body so that the switch is presented almost flush with the rail. This is a highly desirable location which is easily operated by the users' thumb while gripping the dovetail rail system on a rifle platform. However, as can be appreciated, the mount body can be contoured with other desirable shapes and the switch can be located anywhere on the body. Removing the switching and control functions from the electronic accessory allows the accessories to become smaller and more easily configured for closer mounting to the rail.

Moreover, separating the mount and control functions from the main accessory housing allows the user to potentially select from multiple different mounts having different mounting and control configurations. As indicated above, adaptability and customization is critical in this product category.

Accordingly, it can be seen that the present disclosure provides a unique and novel mounting and control solution for any electronic weapon accessory.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
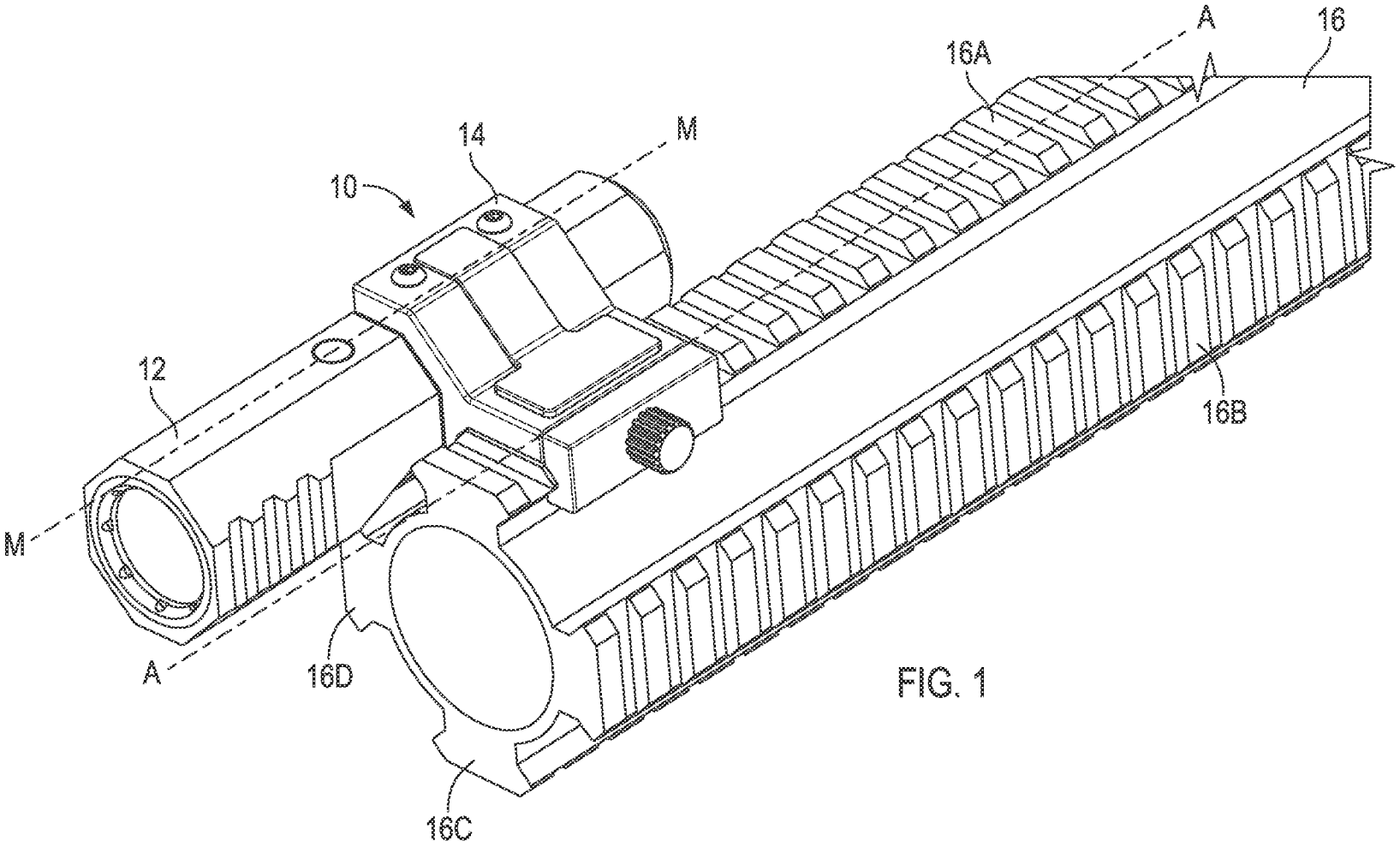
FIG. 1 is a perspective view of an exemplary embodiment mounted on a rail system.
Figure 2:
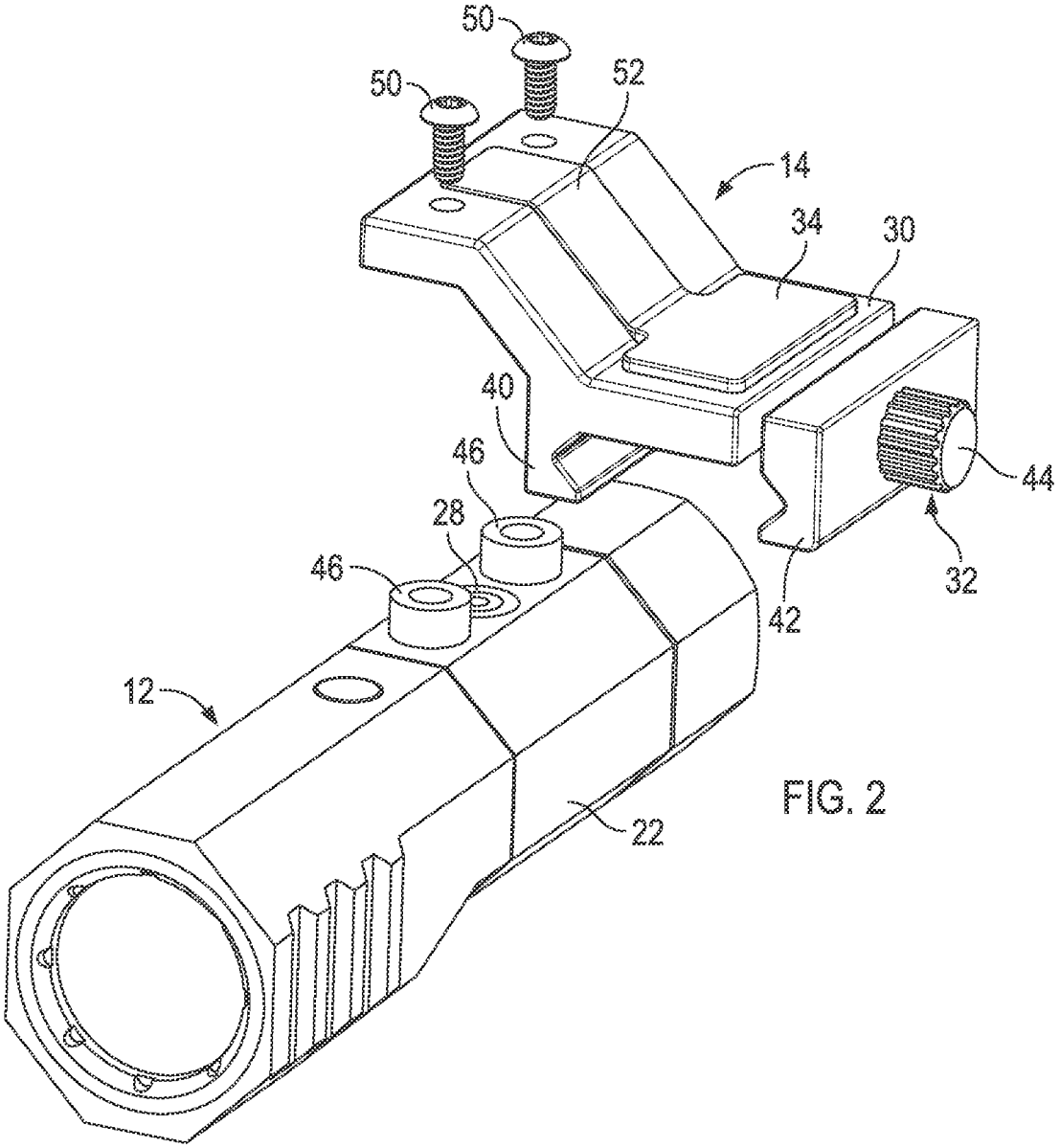
FIGS. 2-4 are exploded perspective views of the electronic weapon accessory and mount.
Figure 3:
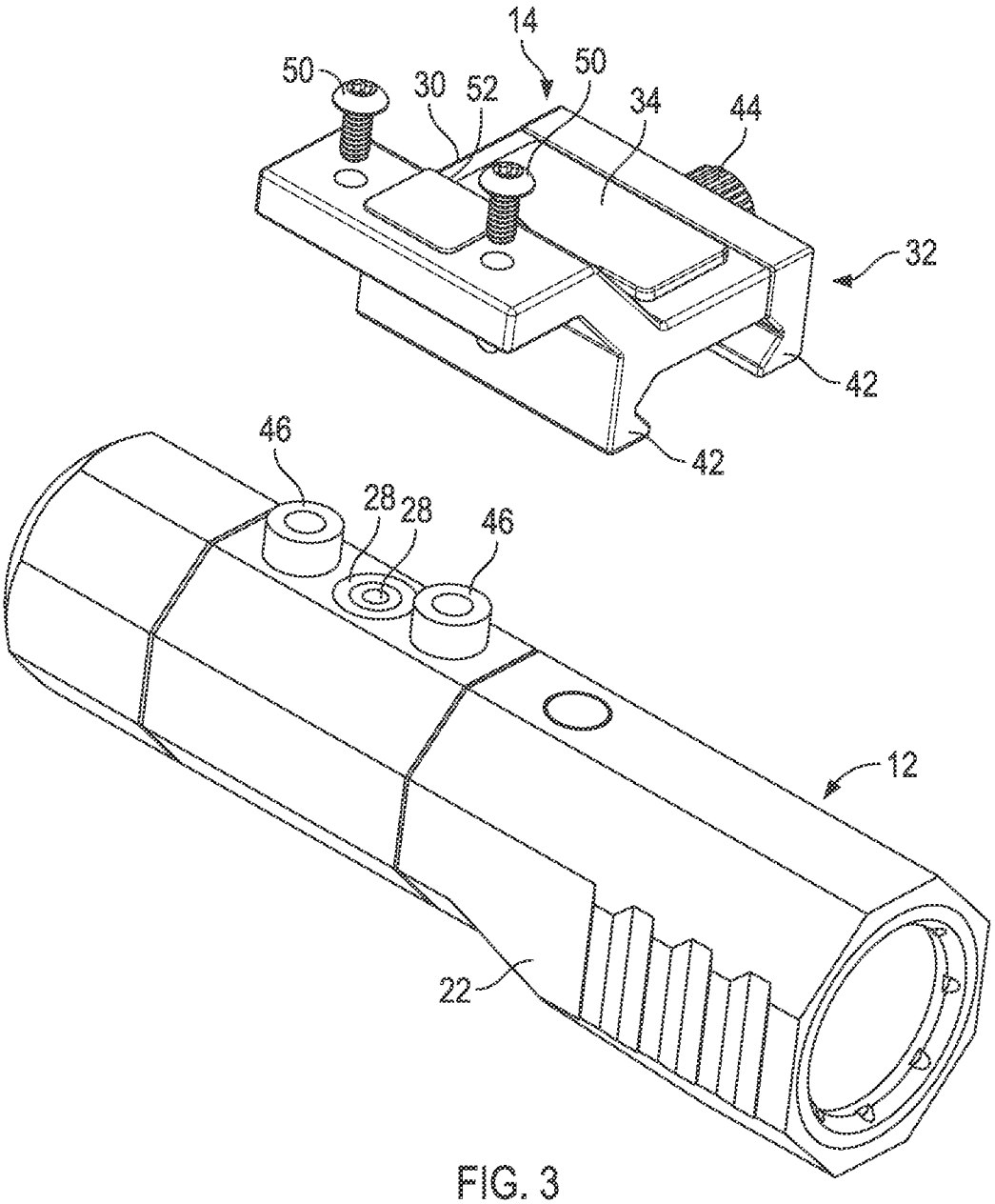
Figure 4:
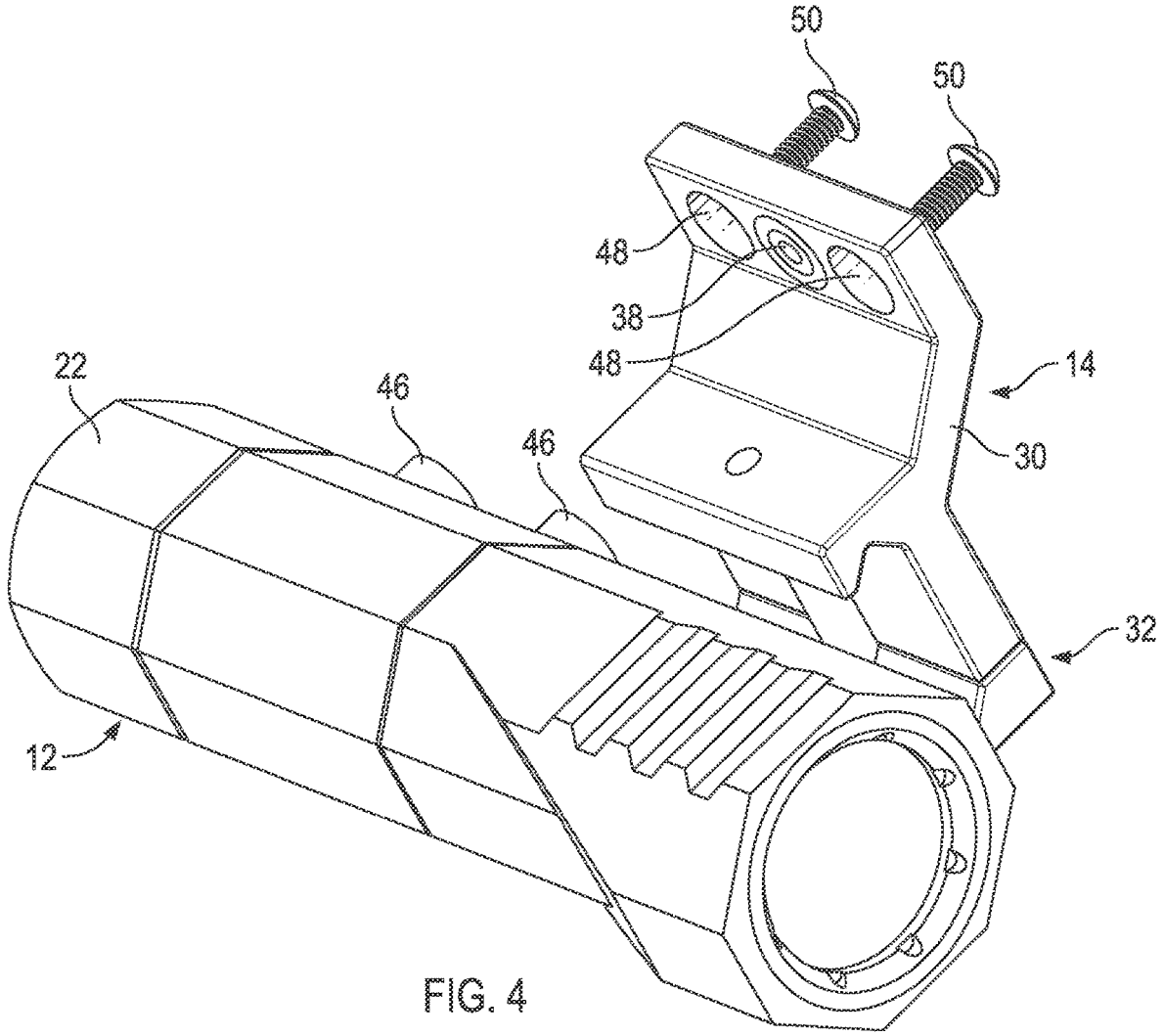
Figure 5:
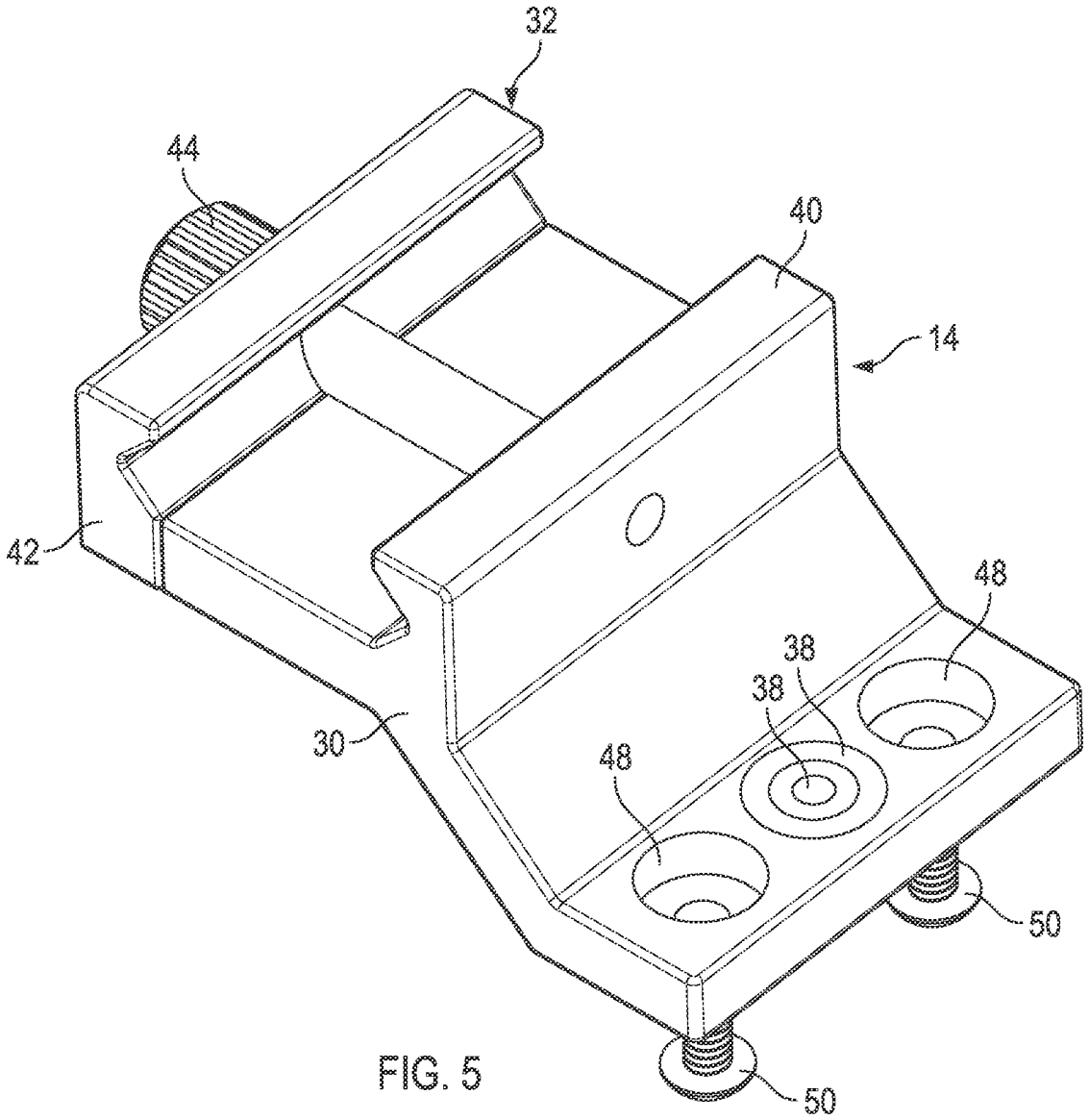
FIG. 5 is a bottom perspective view of the mount.
Figure 6:
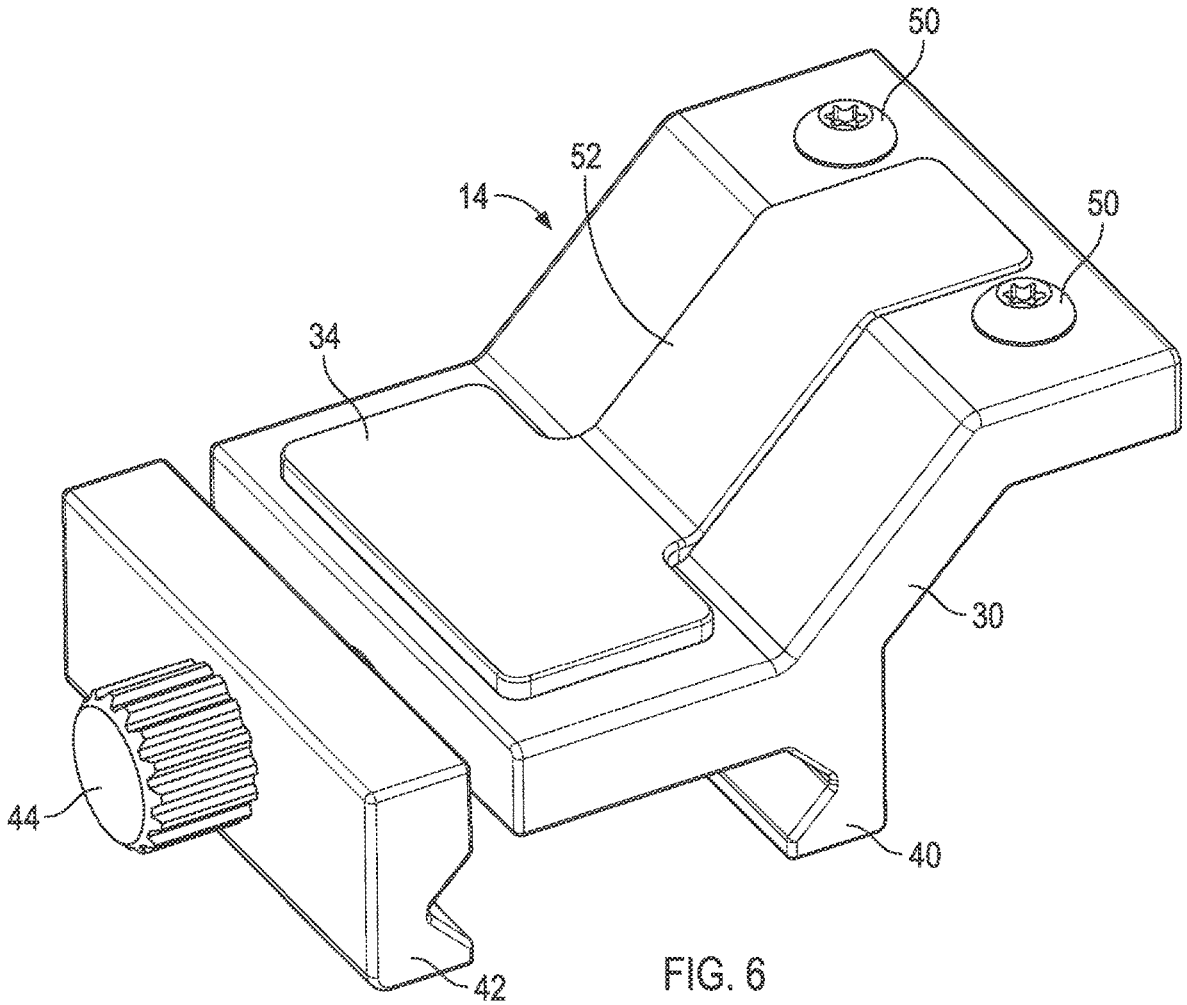
FIG. 6 is a top perspective view of the mount.
Figure 7:
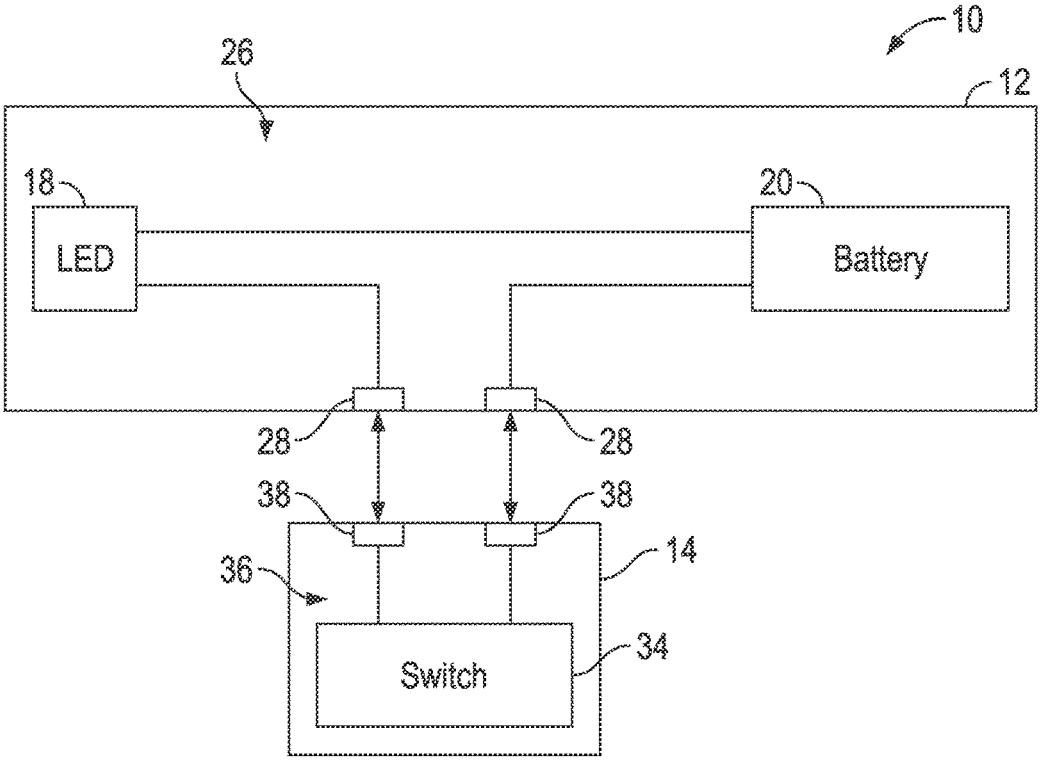
FIGS. 7-10 are schematic block diagrams of further exemplary embodiments of the electronic weapon accessory system.

Referring now to the drawings, an exemplary embodiment of the invention is generally indicated at 10 in FIGS. 1-7. The invention relates to an electronic weapon accessory system 10 including an electronic weapon accessory 12, such as a flashlight, and a detachable mount 14 for the accessory, which both have mating electrical contacts at the mechanical interface between the two components. Generally, the detachable mount 14 includes integrated control apparatus that is external to the accessory 12. The detachable mount 14 can be removed, and/or reversed to provide a variety of mounting and control configurations or can be entirely replaced with a differently shaped or configured mount with a different switching and/or control interface.

Referring to FIG. 1, the mount 14 is configured for attachment to a MIL-STD 1913 dovetail attachment rail or rail system 16. As noted above, many of the semi-automatic rifle systems include rail systems 16 having four separate rails 16A, 16B, 16*c*, 16D surrounding the barrel (not shown) to provide maximum mounting surface area. Each of these mounting rails 16 has a longitudinal axis A, which extends parallel to the longitudinal axis of the barrel of the weapon (not shown) to which it is attached.

Figure 8:
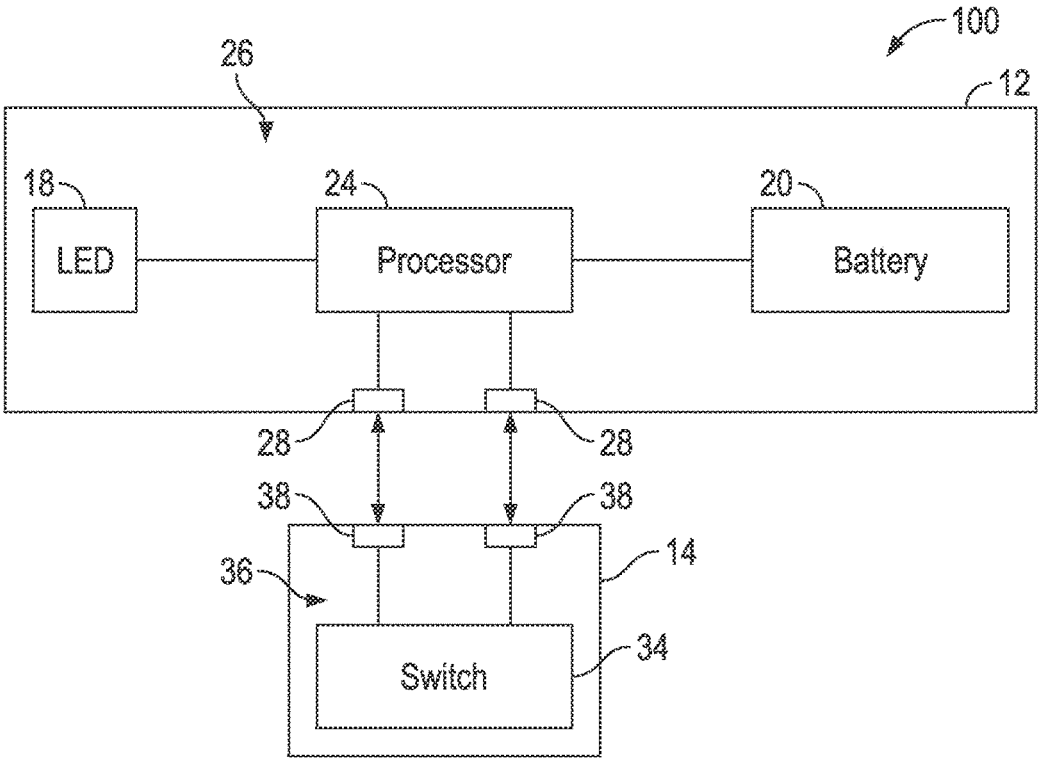
Figure 9:
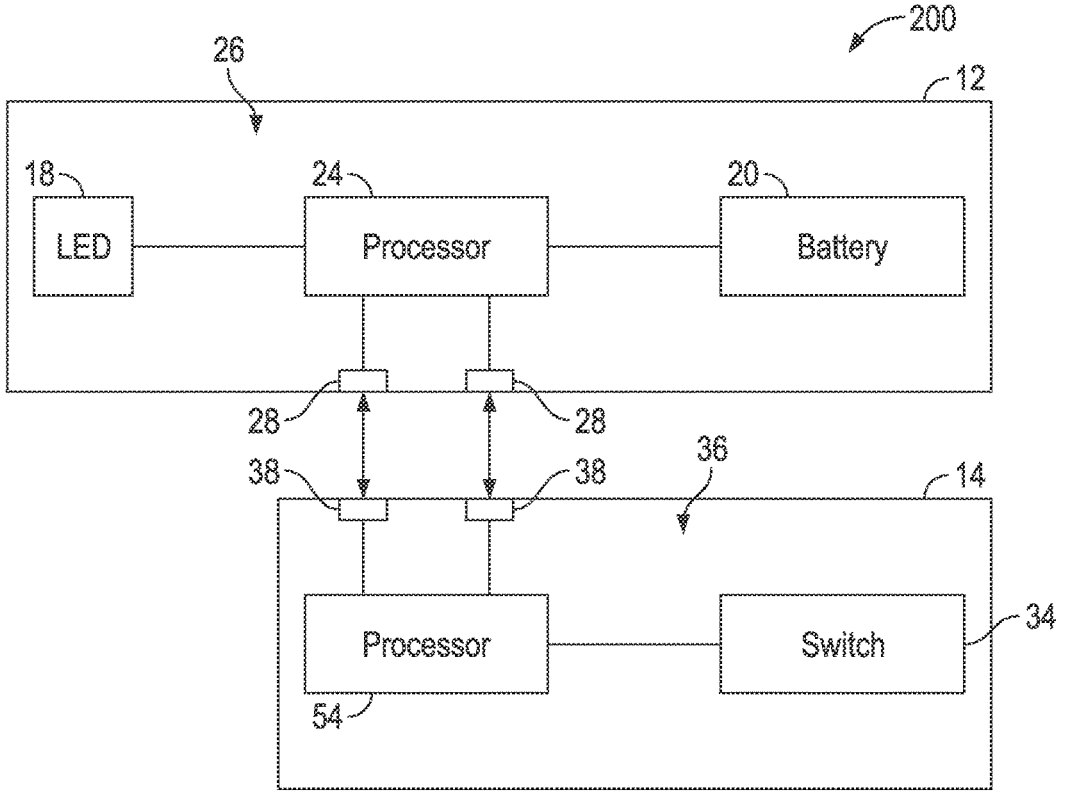
Figure 10:
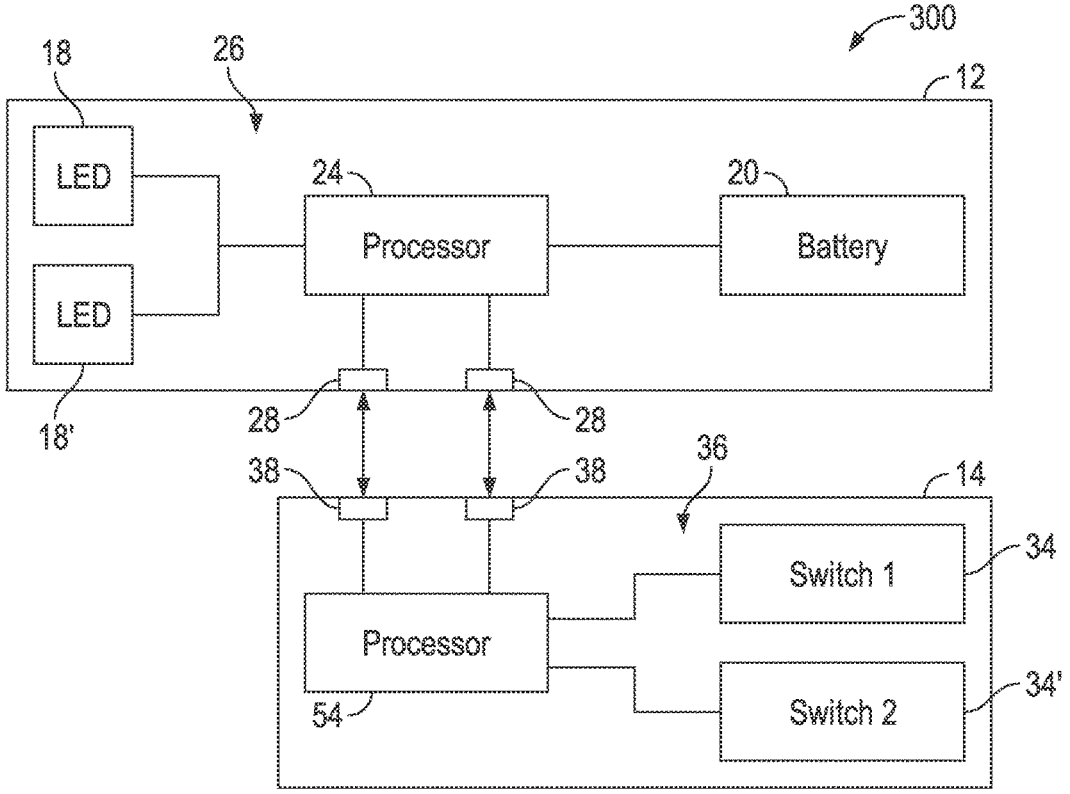
Figure 11:
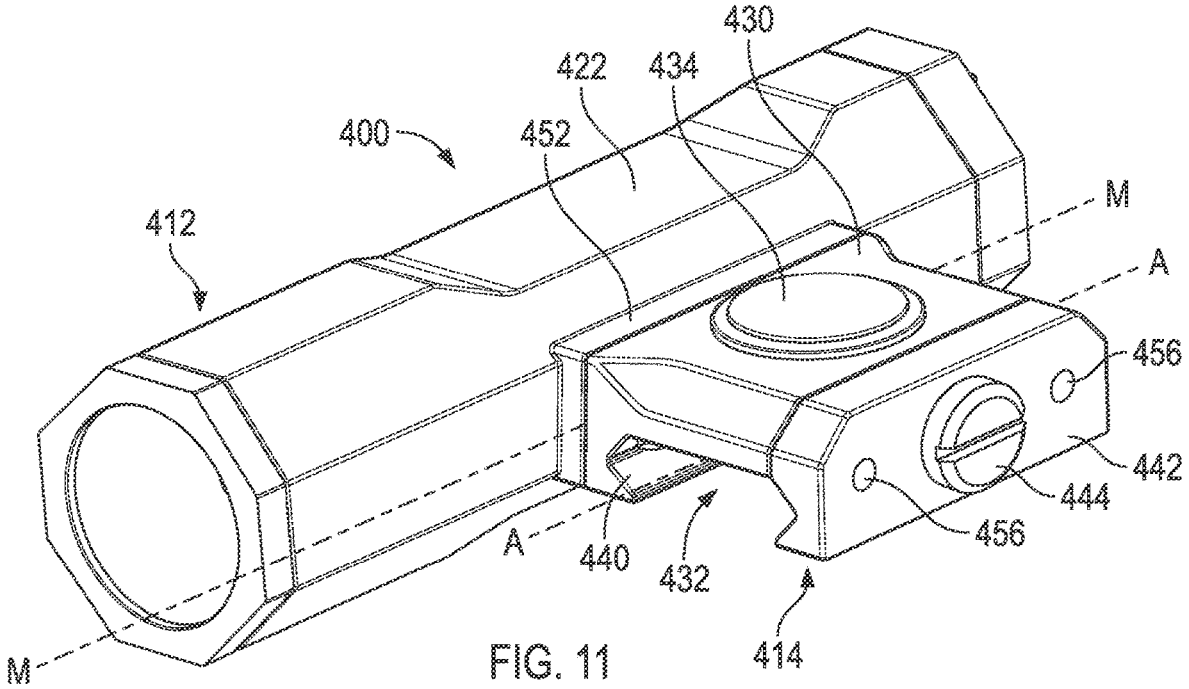
FIGS. 11-12 are perspective views of another exemplary embodiment.
Figure 12:
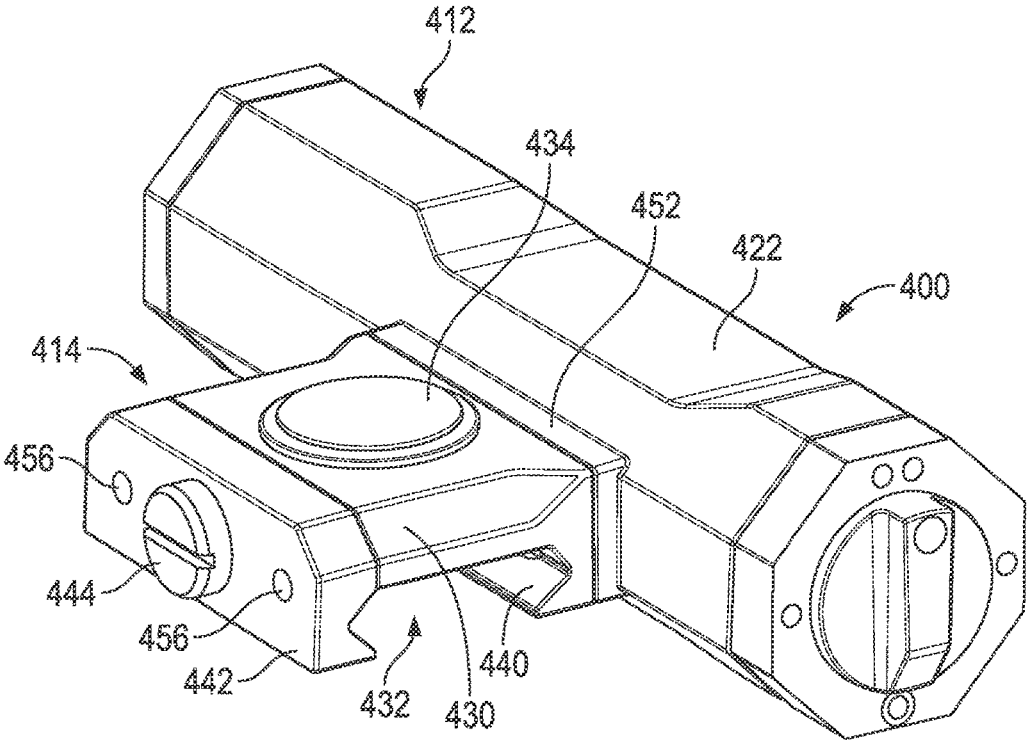
Figure 13:
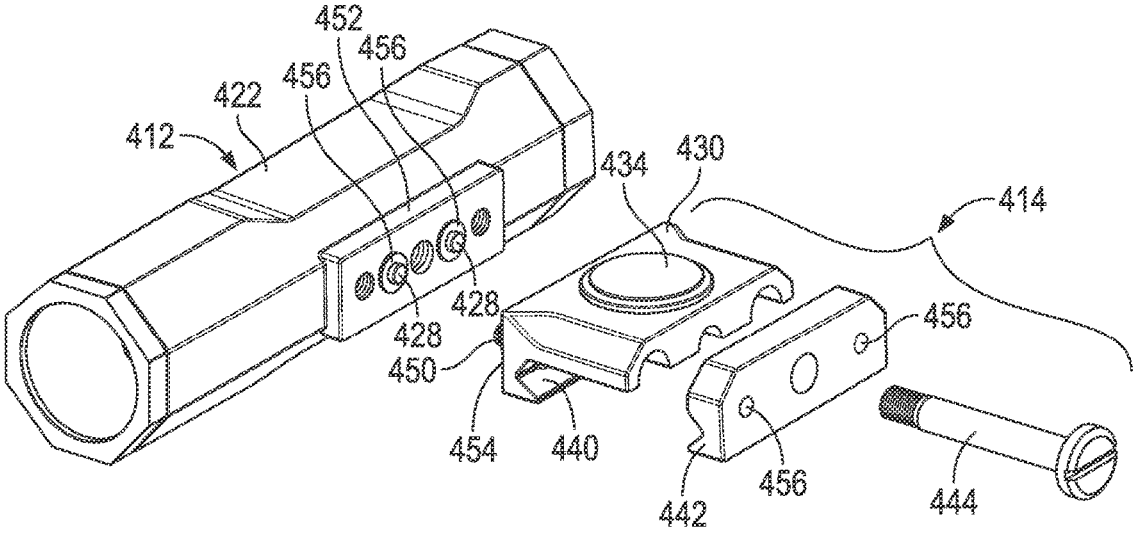
FIGS. 13-14 are exploded perspective views thereof.
Figure 14:
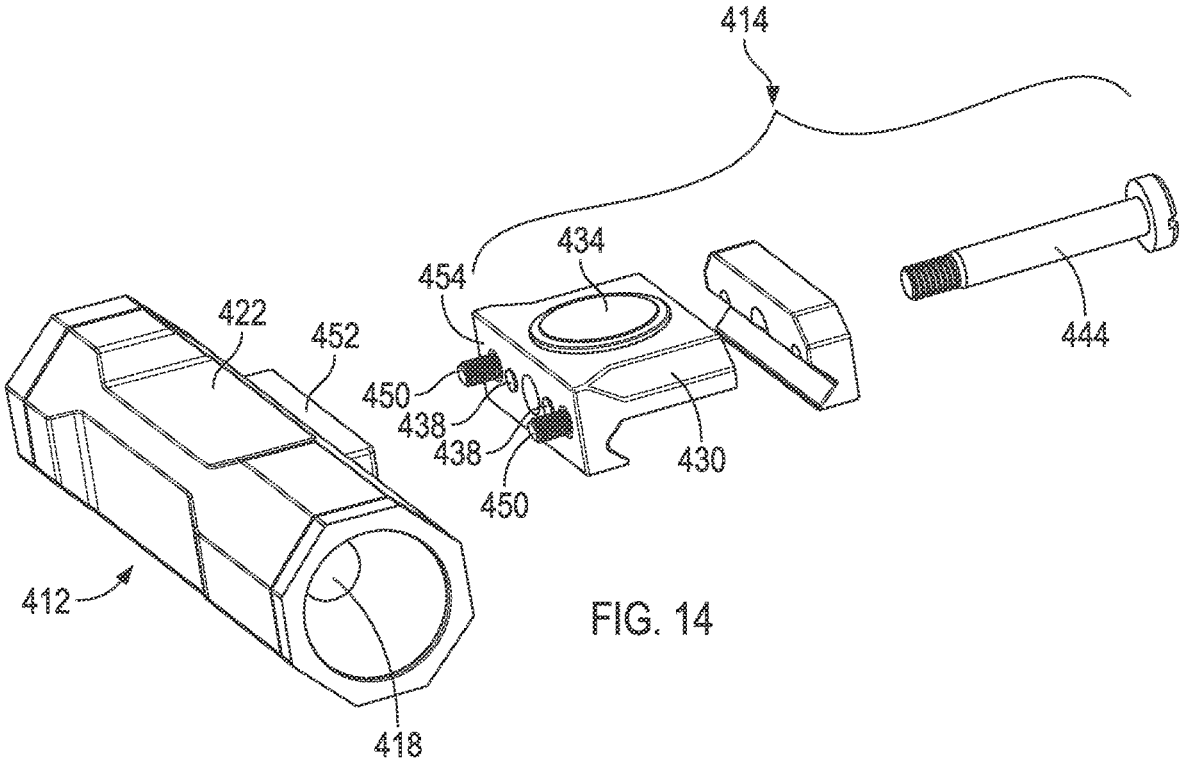

More specifically, the electronic weapon accessory system 10 includes an electronic weapon accessory 12, such as an LED light, and a detachable mount 14 with integrated controls. The electronic weapon accessory 12 includes an electronic component 18, such as an LED, and a power source (battery) 20 disposed within an accessory housing 22. The accessory 12 may comprise any electronic device mountable on a weapon platform, including LED lights, IR illuminators, lasers, range finders, etc. and in this regard, the accessory 12 may further include a processor 24 for control of the accessory 12 (FIGS. 8-10).

Referring back to FIGS. 2-6, the electronic component 18, the processor 24 and the battery 20 are electrically connected with a circuit 26 having electrical contacts 28 exposed on an outer surface of the housing 22. The contacts 28 may comprise contact pads, pins, spring pins, etc. The exemplary embodiment includes concentric contact pads 28 which are molded into the plastic housing 22 of the electronic accessory 12. Other configurations are contemplated as illustrated in other exemplary embodiments described hereinbelow.

Still referring to FIGS. 2-6, the mount 14 has a body 30 with a dovetail rail clamp generally indicated at 32, a switch 34 disposed on an outer surface of the mount body 30 and a circuit 36 electrically connected with the switch 34 having electrical contacts 38 exposed on the outer surface of the mount body 30.

The exemplary embodiment of the dovetail rail clamp 32 includes a fixed clamp edge 40 on the mount body 30 and a movable clamp element 42 secured with a thumb screw 44. Other clamping arrangements are contemplated including any one of the current lever actuated mounts.

The accessory housing 22 and the mount body 30 include interfitting mating formations 46, 48 which are received together in interfitting mating relation for alignment of the mount body 30 with the accessory housing 22. The formations 46, 48 are preferably configured so that they are reversible or adjustable to provide alternate orientations. For example, paired formations, as illustrated, are formed on complementary mating surfaces which extend along a mating axis M which is parallel to the rail axis A. These complementary formations extending along parallel axes allow the mount 12 to be reversibly configured for left or right hand mounting, or upper and lower mounting depending on the desired mounting location on the dovetail rail 16. Referring to FIG. 1, it can be easily appreciated that the mount 14 and accessory 12 can be configured to be mounted on either side of any one of the four rails 16A, 16B, 16C and 16D so that the light 12 faces forward in all of the mounting configurations. Other formations may provide additional mounting orientations. Fasteners 50 removably secure the mount body 30 and accessory housing 22 in assembled relation. Preferably, the fasteners 50 are adjacent the mating formations 46, 48 and may pass through the formations 46, 48.

The exemplary embodiment 10 may further include a waterproofing gasket (not shown) surrounding the electrical contacts 28, 38 which is received in complementary gasket channels (not shown) surrounding the contacts 28, 38 on both the accessory housing 22 and the mount 30.

The exemplary embodiment of the mount 14 may be formed from metal for strength, durability and repeatable mounting with the clamp 32. When integrating the electrical circuit 36 within a metal body 30, insulating materials (not shown) may be used to isolate the electrical components from the metal body 30. The mount 14 may further include a rubberized gasket or cover 52, either molded with, or removably received over the external switch 34 on the outer surface.

When the electronic weapon accessory 12 and mount 14 are secured in assembled relation (FIG. 1), the accessory electrical contacts 28 physically and electrically engage the mount electrical contacts 38 to provide a completed electronic control circuit and provide integrated control and operation of the electronic accessory 12 with the switch 34 on the mount 14.

The mount 14 may further include additional switches 34, 34' (FIG. 10) for more sophisticated electronic accessories requiring multiple controls, and may also include a separate processor 54 (FIGS. 8-10) to provides additional switching and control functionality using one or more switches 34, 34'.

Referring to FIG. 8 a second exemplary embodiment 100 is illustrated wherein the electronic accessory 12' has an internal processor 24 integrated into the control circuit. The processor 24 is then connected to the control switch 34 though the mated surface contacts 28, 38.

Referring to FIG. 9 a third exemplary embodiment 200 is illustrated where the mount 14 also includes an integrated processor 54. The electronic accessory 12 may, or may not, include another processor.

Referring to FIG. 10, a fourth exemplary embodiment 300 is illustrated where the mount 14 includes multiple switches 34, 34' integrated with a control processor 54 for added control and functionality.

Turning now to FIGS. 11-15, another exemplary embodiment 400 is illustrated. The electronic configuration of the accessory system 400 may be the same as any of the earlier embodiments 10, 100, 200, 300 shown in FIGS. 1-10. However, the mechanical configuration is slightly different.

Weapon accessory system 400 includes an electronic weapon accessory 412, such as a flashlight, and a detachable mount 414 for the accessory, which both have mating electrical contacts 428, 438 at the mechanical interface between the two components. Detachable mount 414 includes integrated control apparatus that is external to the accessory 412. The detachable mount 414 can be removed, and/or reversed to provide a variety of mounting and control configurations or can be entirely replaced with a differently shaped or configured mount with a different switching and/or control interface.

Mount 414 is also configured for attachment to a MIL-STD 1913 dovetail attachment rail or rail system 16, although other rail configurations are contemplated.

Weapon accessory 412 includes an electronic component 418, such as an LED, and a power source (battery—not shown) disposed within an accessory housing 422. As indicated above, the accessory 412 may comprise any electronic device mountable on a weapon platform, including LED lights, IR illuminators, lasers, range finders, etc. and in this regard, the accessory 412 may further include a processor (not shown) for control of the accessory 412.

The electronic component 418 is electrically connected with electrical contacts 428 exposed on an outer surface of the housing 422. This exemplary embodiment includes spaced, spring-loaded contact pins 428 (pogo pins) which are molded into the side of the plastic housing 422 of the electronic accessory 412.

The mount 414 has a body 430 with a dovetail rail clamp generally indicated at 432, a switch 434 disposed on an outer surface of the mount body 430 and a circuit electrically connected with the switch 434 having fixed electrical contact pads 438 exposed on the outer surface of the mount body 430.

The exemplary embodiment of the dovetail rail clamp 432 includes a fixed clamp edge 440 on the mount body 430 and a movable clamp element 442 secured with a screw 444. Other clamping arrangements are contemplated including any one of the current lever actuated mounts, and/or any other rail connection system.

The mechanical configuration of the present embodiment 400 is slightly different than the previous embodiments to accommodate a side connection location rather than a top connection and added wall thickness required for travel of the pogo pins 428. Accessory housing 422 includes a planar mating platform 452 raised above the outer surface of the housing 422. Likewise, mount body 414 includes a complementary planar mating platform 454. The mating platforms 452, 454 are configured so that they are reversible or adjustable to provide alternate orientations, and like the earlier embodiments, the mating platforms 452, 454 are aligned along a mating axis M which is parallel to the rail axis A. These mating platforms allow the accessory 412 to be reversibly configured for left or right hand mounting, or upper and lower mounting depending on the desired mounting location on the dovetail rail 16. Referring to FIG. 1, it can be easily appreciated that the mount 414 and accessory 412 can be configured to be mounted on either side of any one of the four rails 16A, 16B, 16C and 16D so that the light 412 faces forward in all of the mounting configurations.

Figure 15:
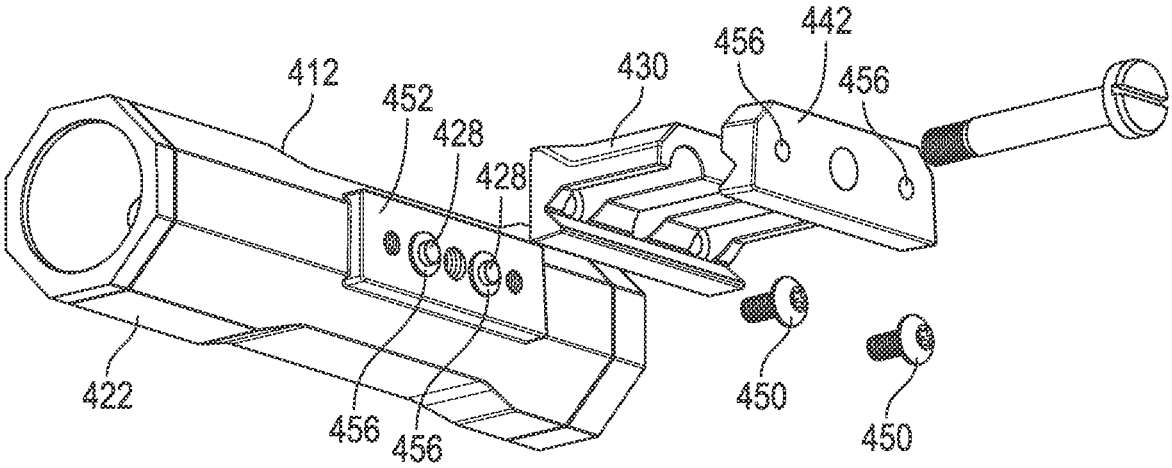
FIG. 15 is yet another exploded perspective showing the attachment screws for connecting the mount to the mating platform.

Referring briefly to FIG. 15, the exemplary embodiment 400 further includes waterproofing gaskets 456 surrounding the electrical contacts 428 which are received in complementary gasket channels surrounding the contacts 428 on the accessory housing 422. Fasteners 450 removably secure the mount body 430 and accessory housing 422 in assembled relation. Preferably, the fasteners 450 are adjacent to the contacts 428, 438 to insure a solid waterproof connection. The movable clamp element 442 includes through holes 456 which allow access to the heads of the fasteners 450.

When the electronic weapon accessory 412 and mount 414 are secured in assembled relation (FIG. 11), the accessory electrical contacts 428 physically and electrically engage the mount electrical contacts 438 to provide a completed electronic control circuit and provide integrated control and operation of the electronic accessory 412 with the switch 434 on the mount 414.

Figure 16:
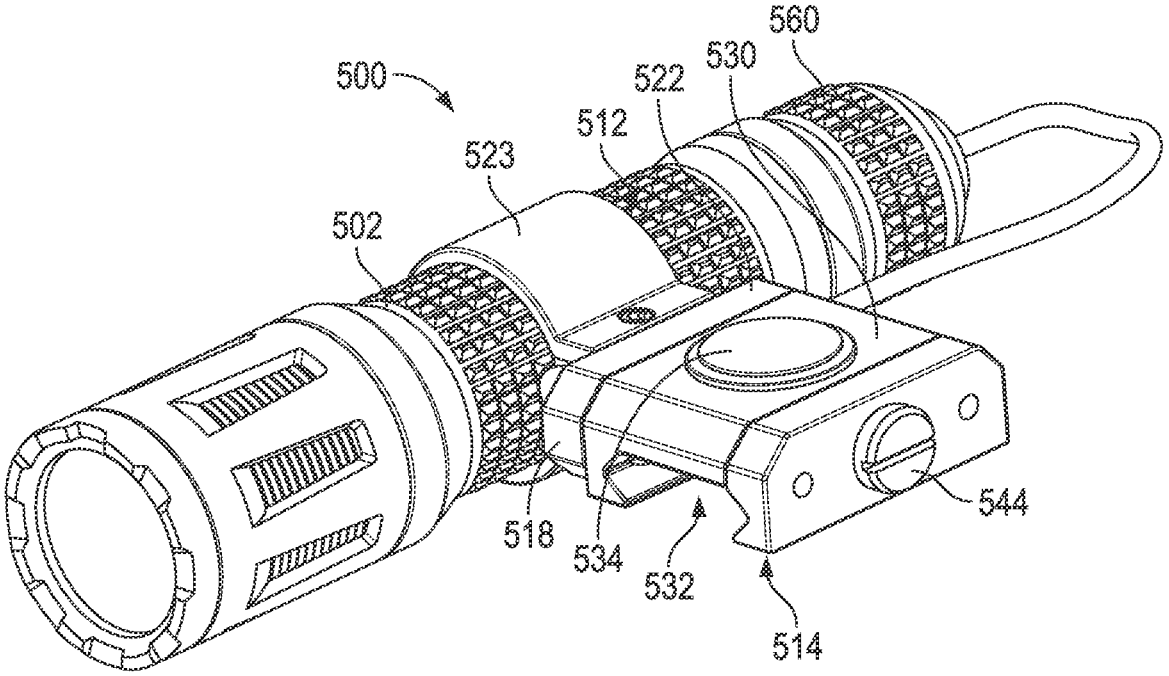
FIGS. 16-17 are perspective views of yet another exemplary embodiment.
Figure 17:
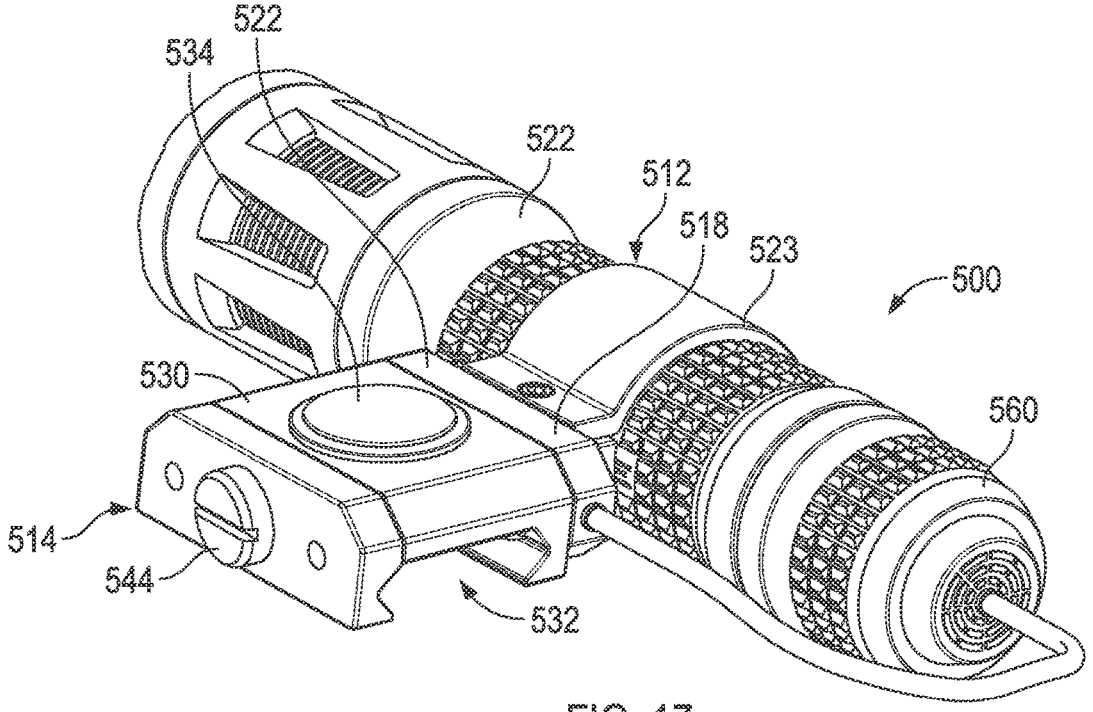
Figure 18:
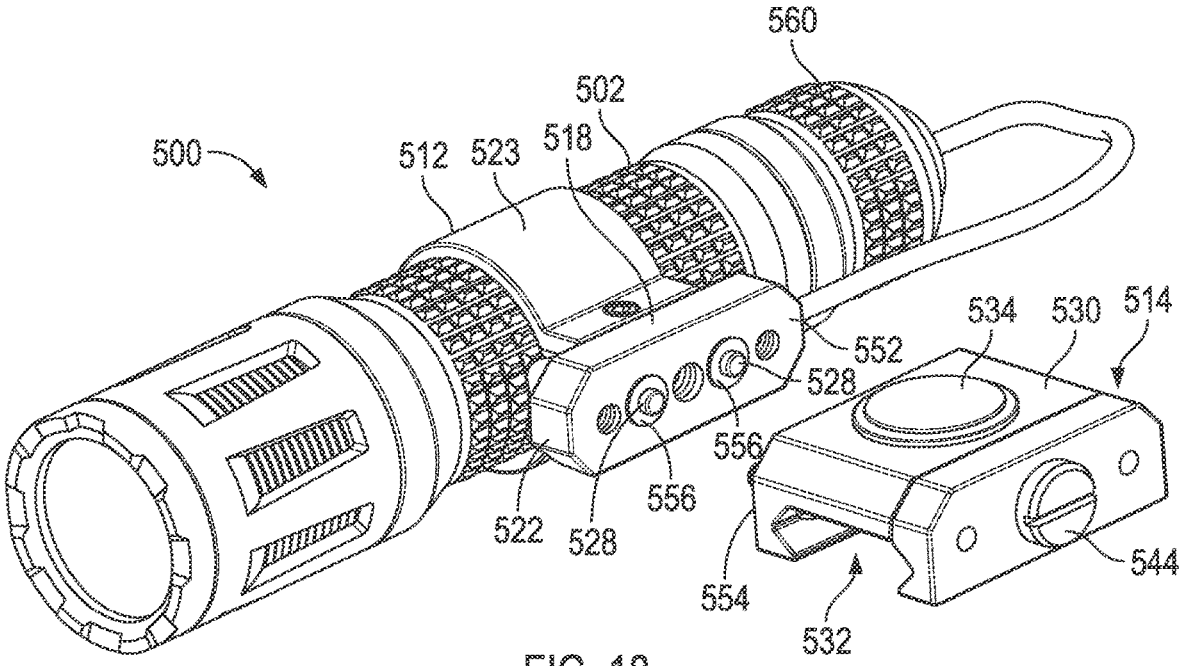
FIG. 18 is an exploded perspective view thereof.
Figure 19:
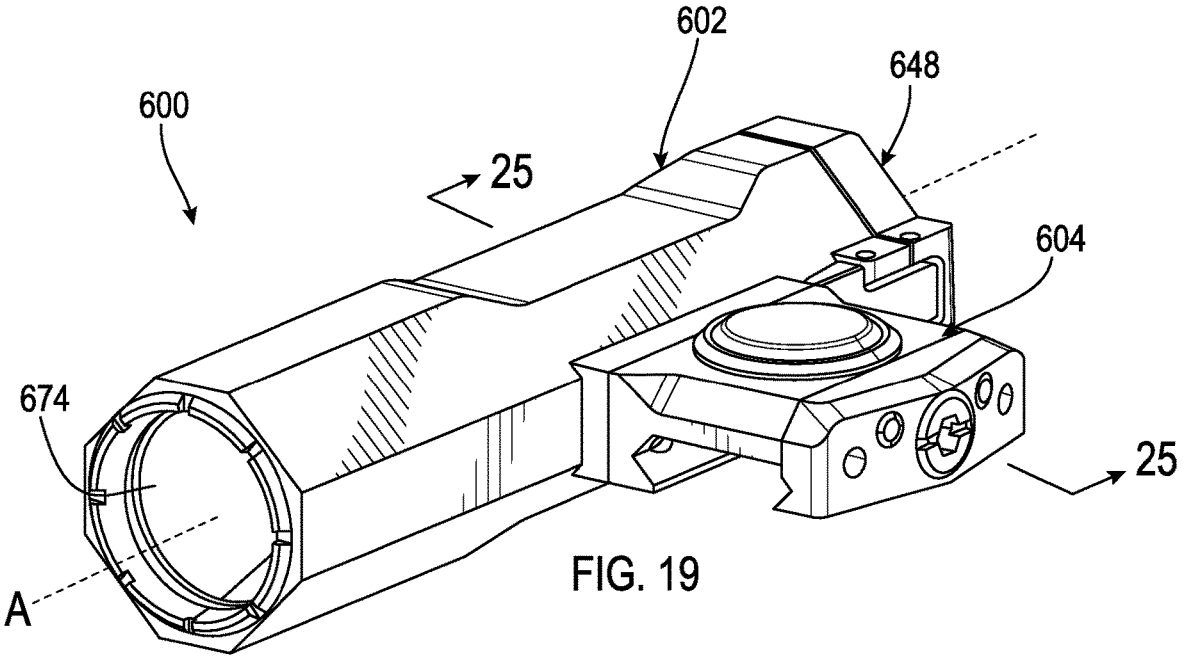
FIG. 19 is a front perspective view of yet another exemplary embodiment.
Figure 20:
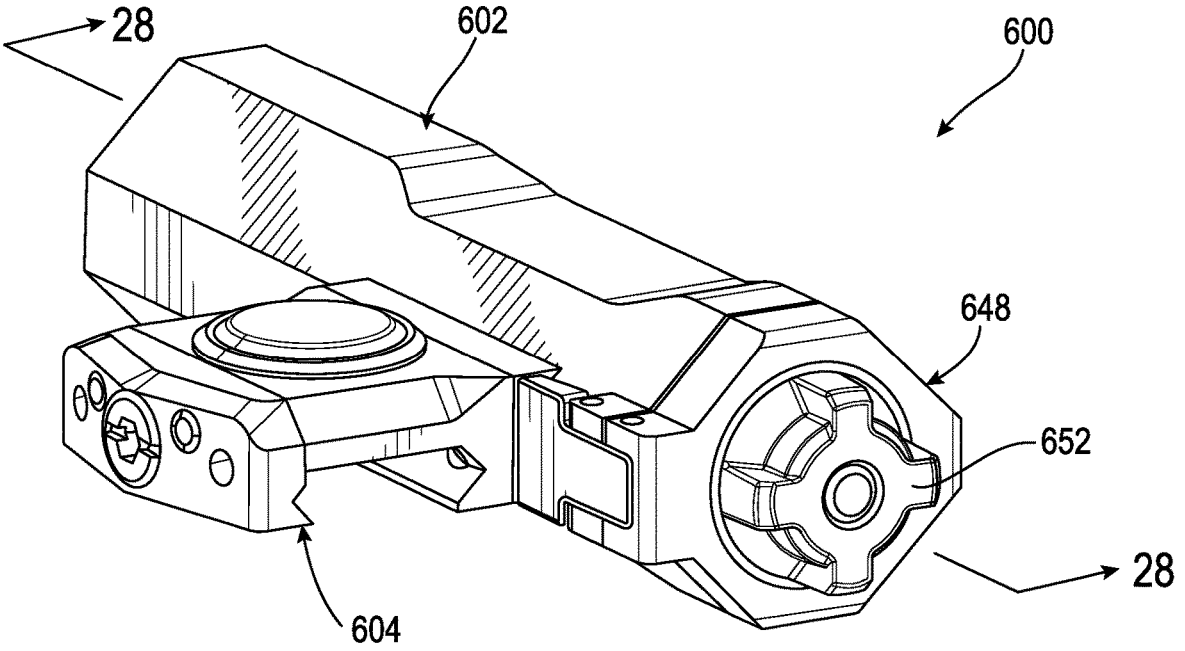
FIG. 20 is a rear perspective view thereof.

Referring to FIGS. 16-18 another exemplary embodiment 500 is illustrated. The electronic configuration of the accessory system 500 may the same as any of the earlier embodiments 10, 100, 200, 300, 400 shown in FIGS. 1-15. However, the mechanical configuration is slightly different.

Weapon accessory system 500 includes an electronic weapon accessory 512 which is useful for controlling a separate conventional weapon accessory, such as a standard flashlight 502 having a tail cap switch and further includes a detachable mount 514 for the accessory. Both the accessory 512 and mount 514 have mating electrical contacts (only 528 shown) at the mechanical interface between the two components as in the embodiment shown in FIGS. 11-14. Detachable mount 514 includes integrated control apparatus that is external to the accessory 512 and to the flashlight 502. The detachable mount 514 can be removed, and/or reversed to provide a variety of mounting and control configurations or can be entirely replaced with a differently shaped or configured mount with a different switching and/or control interface.

Mount 514 is configured for attachment to a MIL-STD 1913 dovetail attachment rail or rail system 16, although other rail configurations are contemplated. Weapon accessory 512 includes a housing 522 including an electronic component 518, which in this embodiment comprises a control circuit terminating in a mating adaptor tail cap 560 for control of the flashlight 502. The adaptor tail cap 560 is mated with the flashlight 502 in the place of a standard tail cap switch to provide an alternate control arrangement.

The electronic component 518 is electrically connected with electrical pogo pin contacts 528 exposed on an outer surface of the housing 522.

The mount 514 has a body 530 with a dovetail rail clamp generally indicated at 532, a switch 534 disposed on an outer surface of the mount body 530 and a circuit electrically connected with the switch 534 having fixed electrical contact pads (not shown) exposed on the outer surface of the mount body 530. Fastener 544 secures the mount to the accessory housing 522.

The mechanical configuration of the present embodiment 500 includes an accessory housing 522 with a clamping ring 523 which is received around the body of any conventional flashlight 502. Accessory housing 522 includes a planar mating platform 552. Likewise, mount body 514 includes a complementary planar mating platform 554. The mating platforms 552, 554 are configured so that they are reversible or adjustable to provide alternate orientations, and like the earlier embodiments, the mating platforms 552, 554 are also aligned along a mating axis M which is parallel to the rail axis A (see FIGS. 11-15). These mating platforms allow the accessory 512 to be reversibly configured for left or right hand mounting, or upper and lower mounting depending on the desired mounting location on the dovetail rail 16.

Referring to FIG. 18, the exemplary embodiment 500 further includes waterproofing gaskets 556 surrounding the electrical contacts 528 which are received in complementary gasket channels surrounding the contacts 528 on the accessory housing 522. Fasteners (not shown) removably secure the mount body 530 and accessory housing 522 in assembled relation. Preferably, the fasteners are adjacent to the contacts (only 528 shown) to insure a solid waterproof connection.

When the electronic weapon accessory 512 and mount 514 are secured in assembled relation (FIG. 16), the accessory electrical contacts 528 physically and electrically engage the mount electrical contacts (not shown) to provide a completed electronic control circuit and provide integrated control and operation of the electronic accessory 512 with the switch 534 on the mount 514.

Turning to FIGS. 19-34, a further exemplary embodiment is generally indicated at 600.

The outer physical configuration of the accessory system 600 may be generally the same as the earlier embodiment 400 shown in FIGS. 11-15. However, the internal electrical configuration is modified to accommodate metal body components.

Figure 21:
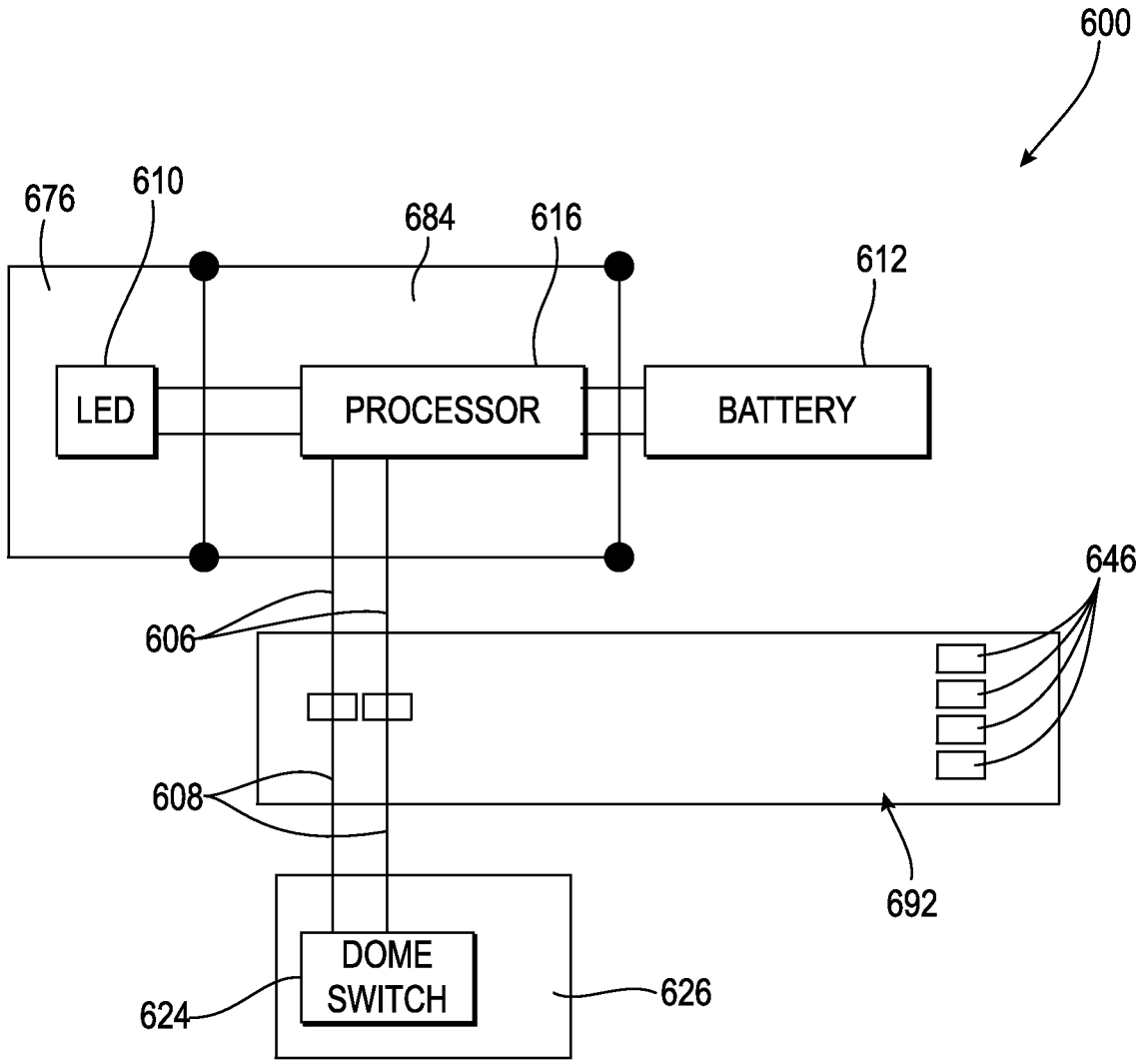
FIG. 21 is a schematic block diagram of the electrical connections thereof.
Figure 22:
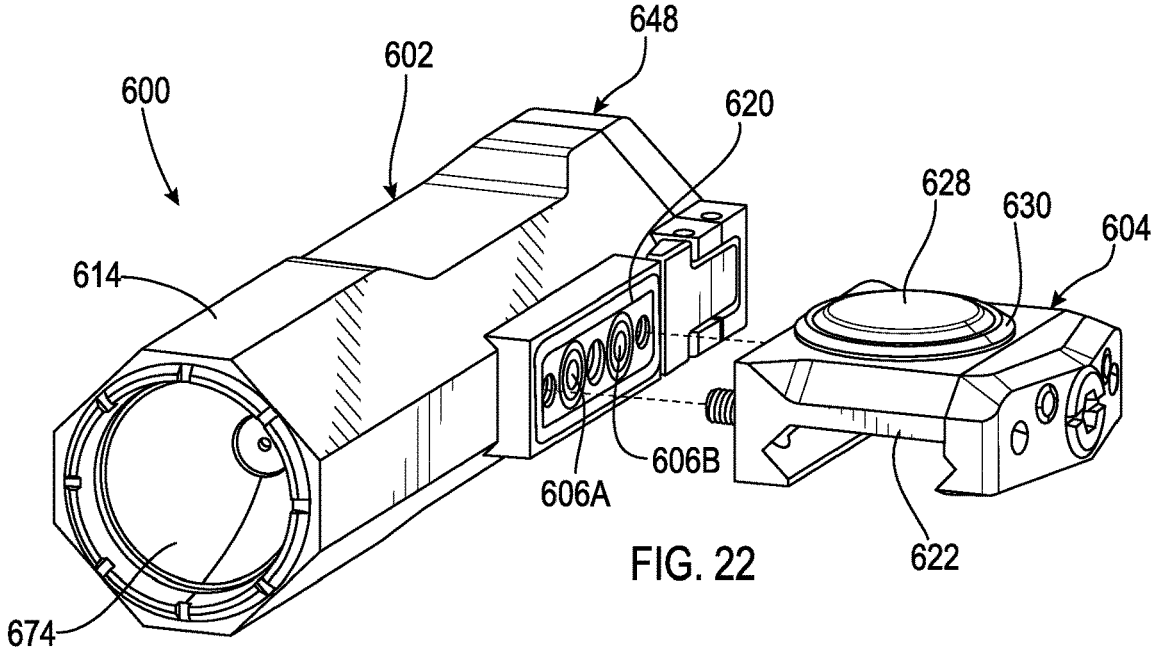
FIG. 22 is an exploded view showing the detachable mount separated from the body of the weapon accessory (flashlight)

Weapon accessory system 600 includes an electronic weapon accessory 602, such as a flashlight as illustrated, and a detachable mount 604 for the accessory, which both still have mating electrical contacts 606A, 606B and 608A, 608B at the mechanical interface between the two components (See FIGS. 21 and 22).

As described above, the detachable mount 604 includes integrated control apparatus that is external to the accessory 602. The detachable mount 604 can be removed, and/or reversed to provide a variety of mounting and control configurations or can be entirely replaced with a differently shaped or configured mount with a different switching and/or control interface.

The mount 604 is configured as previously described for attachment to a MIL-STD 1913 dovetail attachment rail or rail system 16, although other rail configurations are contemplated.

Turning to the schematic in FIG. 21, the accessory 602 includes an electronic component 610, such as an LED, and a battery power source 612 disposed within a metal accessory housing 614. As indicated above, the accessory 602 may comprise any electronic device mountable on a weapon platform, including LED lights, IR illuminators, lasers, range finders, etc. and in this regard, the accessory 602 may further include an internal circuit assembly and processor components 616 for control of the electronic component (LED) 610.

The electronic component (LED) 610 is electrically connected to the mount 604 with electrical contacts 606A, 606B exposed on an outer surface of the housing 614. The exemplary embodiment of the contacts 606A, 606B comprise spaced, spring-loaded contact pins (pogo pins) which are inserted into the side of the metal housing 614. In this regard, the contact pins 606A, 606B are insulated by plastic sleeves 618 which are press fit between the housing 614 and the pins 606A, 606B (best seen in FIG. 22). A single gasket 620 extends around both contacts 606A, 606B.

Figure 23:
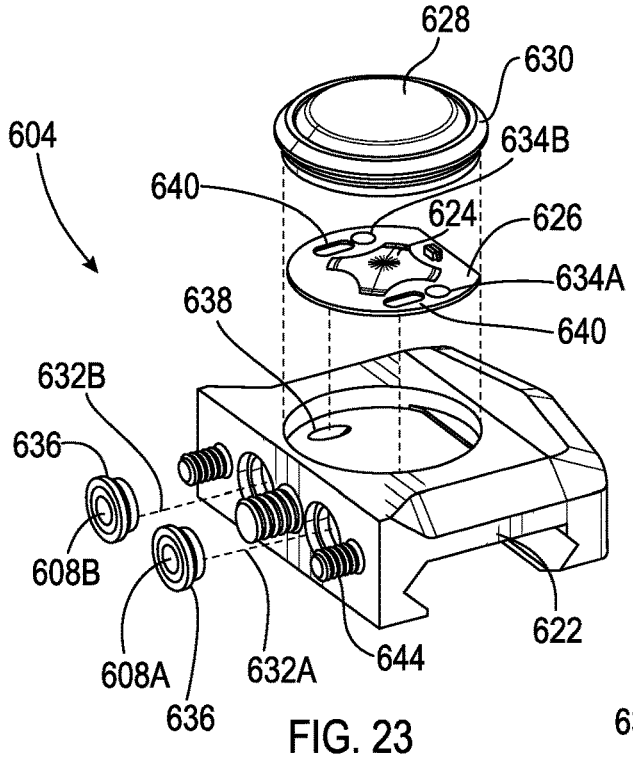
FIGS. 23 and 24 are various exploded perspective views of the detachable mount components.
Figure 24:
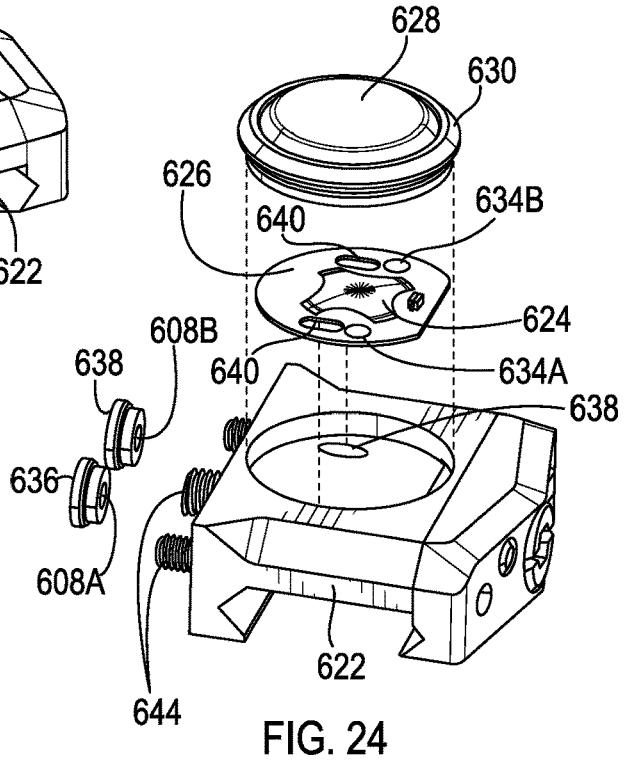
Figure 25:
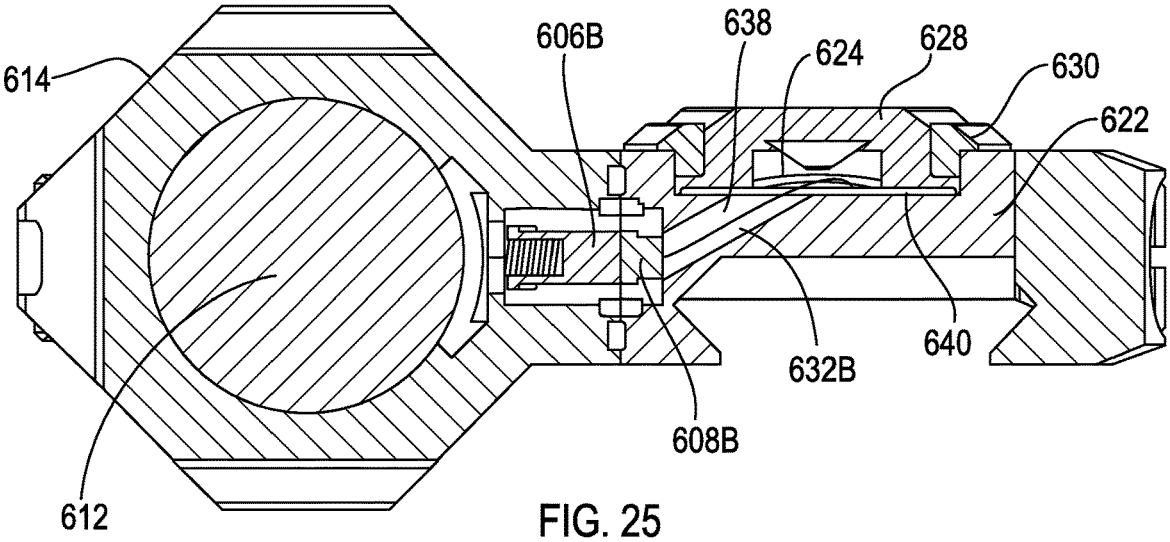
FIG. 25 is a cross-sectional view taken along line 25-25 of FIG. 19.
Figure 26:
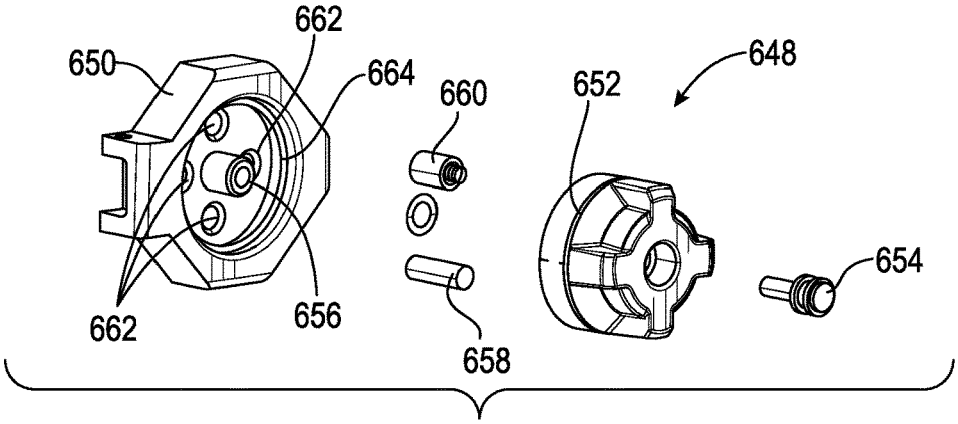
FIGS. 26 and 27 are front and rear exploded perspective view of the end cap including the selector dial.

Referring to FIGS. 23 and 24, the mount 604 has a body 622, and a dome switch 624 mounted on a circuit board 626 which is disposed within mount body 622. An elastomeric cover 628 is retained in place by a press fit ring 630. Contact wires 632A, 632B electrically connect contact pads 634A, 634B on the circuit board 626 with fixed electrical contact pads 608A, 608B press fit into the mating face of the mount body 622. The contacts 608A, 608B are also insulated by plastic insulator sleeves 636 press fit therebetween. The route of the contact wires 632A, 632B is best illustrated in dashed lines in FIGS. 23 and 25 as they extend from the contacts through vias 638 in the mount body 622, up through slots 640A, 640B in the circuit board 626 onto contact pads 642A, 642B on the upper surface of the circuit board 626.

As described in the previous embodiments, fasteners 644 removably secure the mount body and accessory housing in assembled relation.

Figure 27:
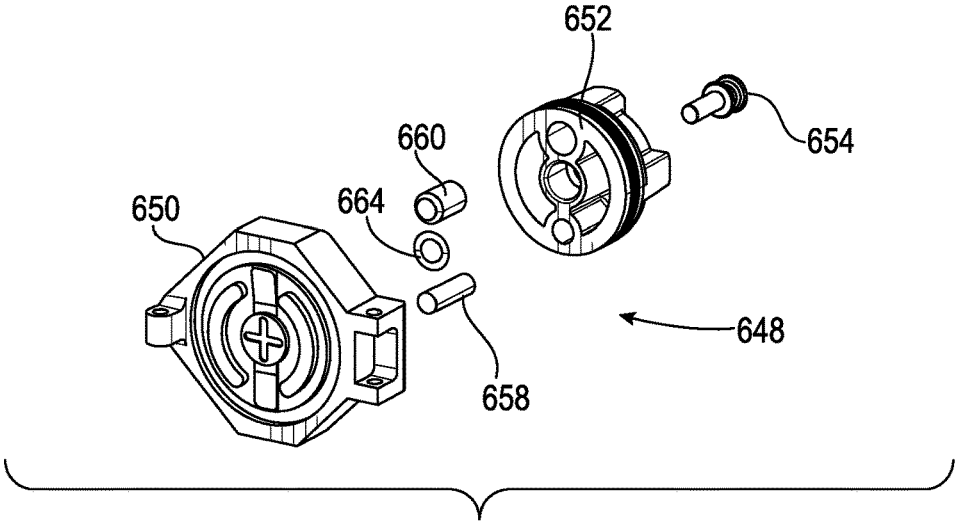
Figure 28:
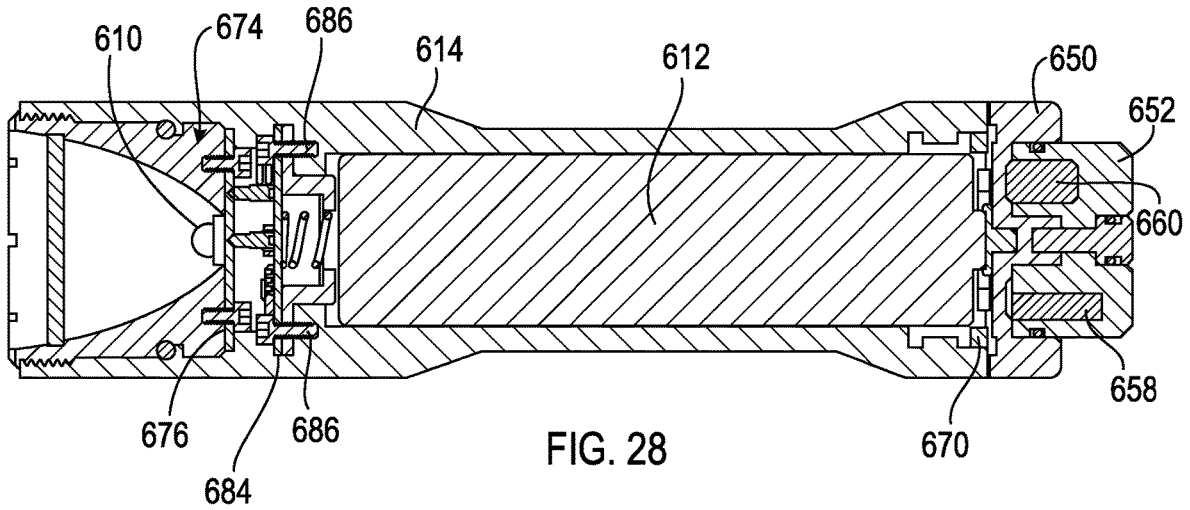
FIG. 28 is a cross-sectional view of the weapon accessory taken along line 28-28 of FIG. 20.
Figure 29:
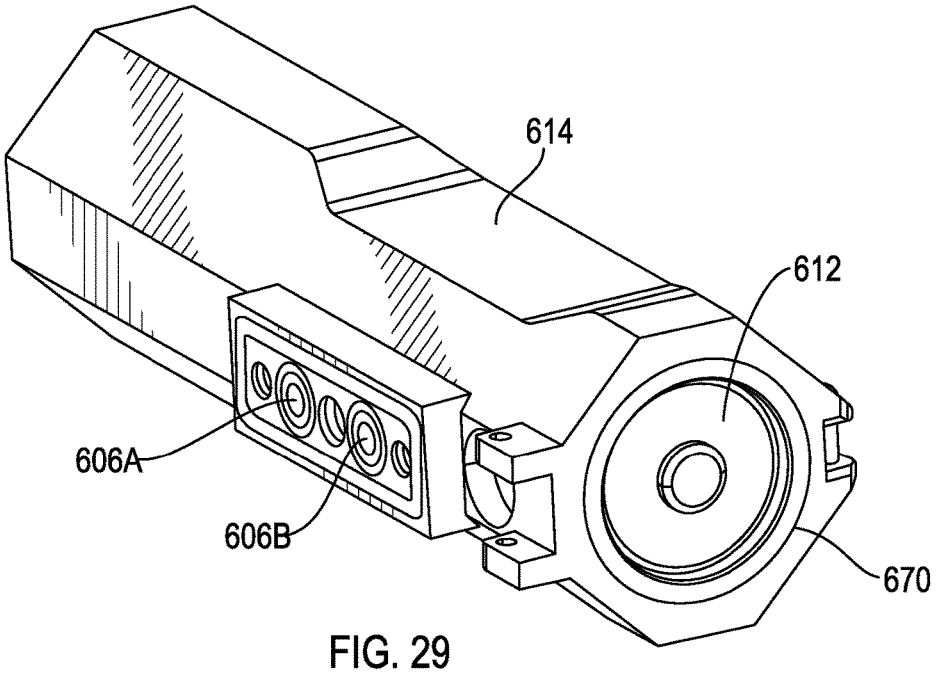
FIG. 29 is a perspective view thereof with the mount detached and the end cap removed.
Figure 30:
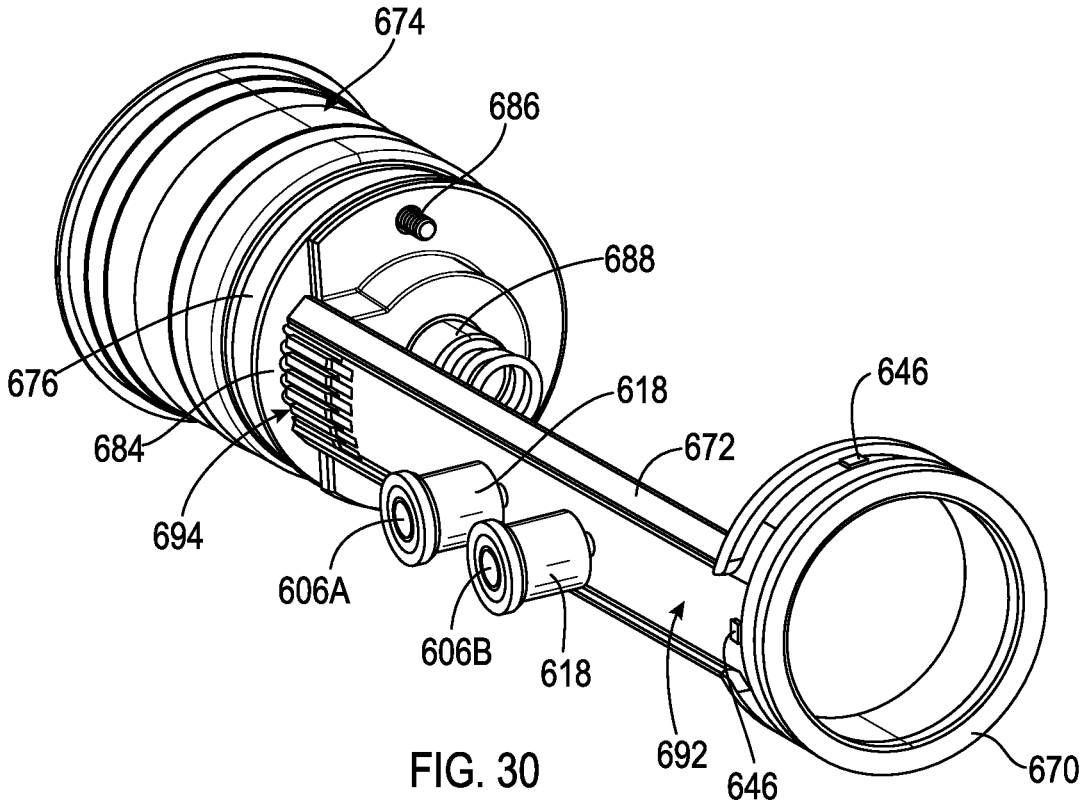
FIG. 30 is a perspective view of the internal cage, circuit board configuration and reflector head assembly.
Figure 31:
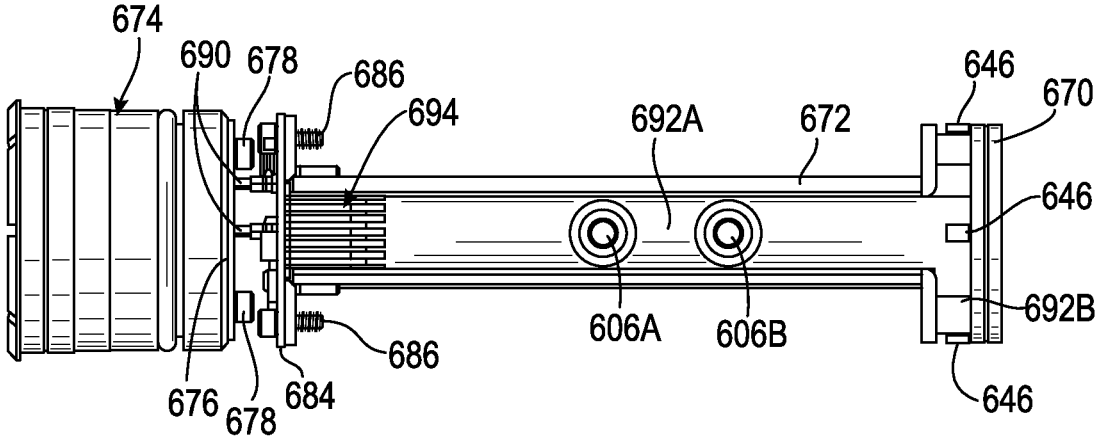
FIG. 31 is a side view thereof.
Figure 32:
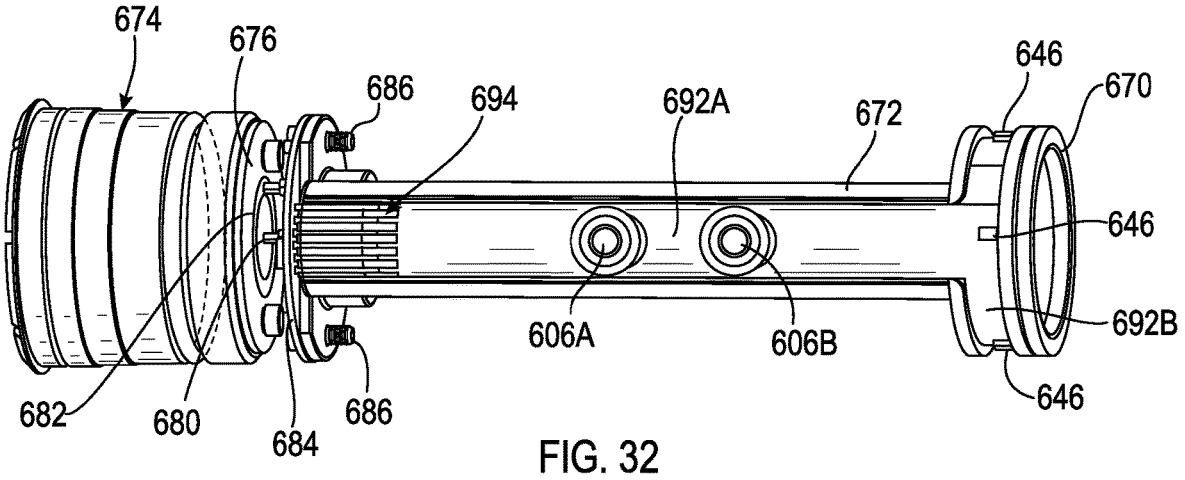
FIG. 32 is another perspective view thereof better showing the connection between the LED circuit board and the main processor circuit board.
Figure 33:
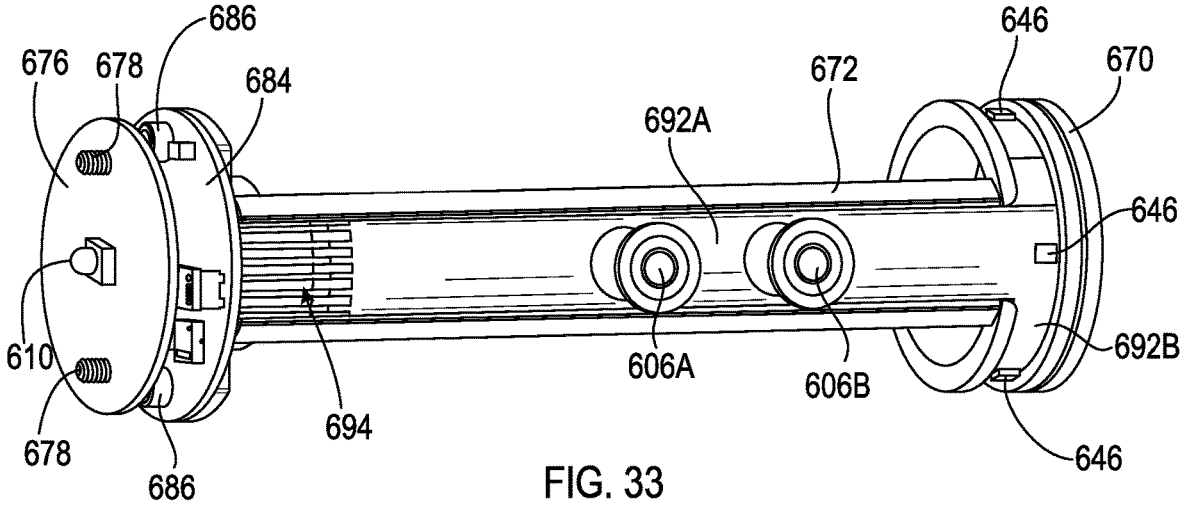
FIG. 33 is a perspective view of just the cage and circuit boards.

In addition to simple on/off functionality, the present circuit configuration includes a plurality of magneto resistive sensors 646, which are circumferentially spaced about the longitudinal axis A of the housing 614 within the rearward or tail end thereof. The details of these magnetic sensors 646 will be described further below. A tail cap assembly 648 includes a body 650 which is hinge mounted to the housing 614 at the tail end and a dial 652 which is axially rotatable about the longitudinal axis. The dial 652 is secured with a press pin 654 extending axially through the dial 652 into a hub 656 in the body 650. The dial 652 includes a radially offset internal magnet 658 operable to selectively activate a respective one of the plurality of magneto resistive sensors 646 when rotatably aligned therewith. The dial 652 further comprises a spring-loaded detent 660 cooperative with respective indents 662 in the body 650 to selectively locate the magnet 658 in alignment with each of the magneto resistive sensors 646 within the housing 614. Gaskets 664 are provided for waterproofing the tail cap assembly 648. As seen in FIG. 27, the internal surface of the body 650 is provided with a positive battery contact 666 and a spreader bar 668 to transfer battery power to the metal housing 614. Turning briefly to FIG. 29, the rear opening of the housing 614 includes a contact ring 670 which is press fit into a shoulder around the battery opening. The spreader bar 668 contacts the contact ring 670 which in turn energizes the metal housing body 614.

Referring now to FIGS. 30-34, the exemplary embodiment employs a unique cage system with several independent circuit boards to provide both control signal and power to a main circuit board and the LED 610. In FIGS. 30-34, a cylindrical polymer cage 672 having forward and rearward ends can be seen, along with all three circuit boards and a reflector cup assembly 674 which is press fit into the front of the housing 614 (or retained by a threaded cap ring).

Figure 34:
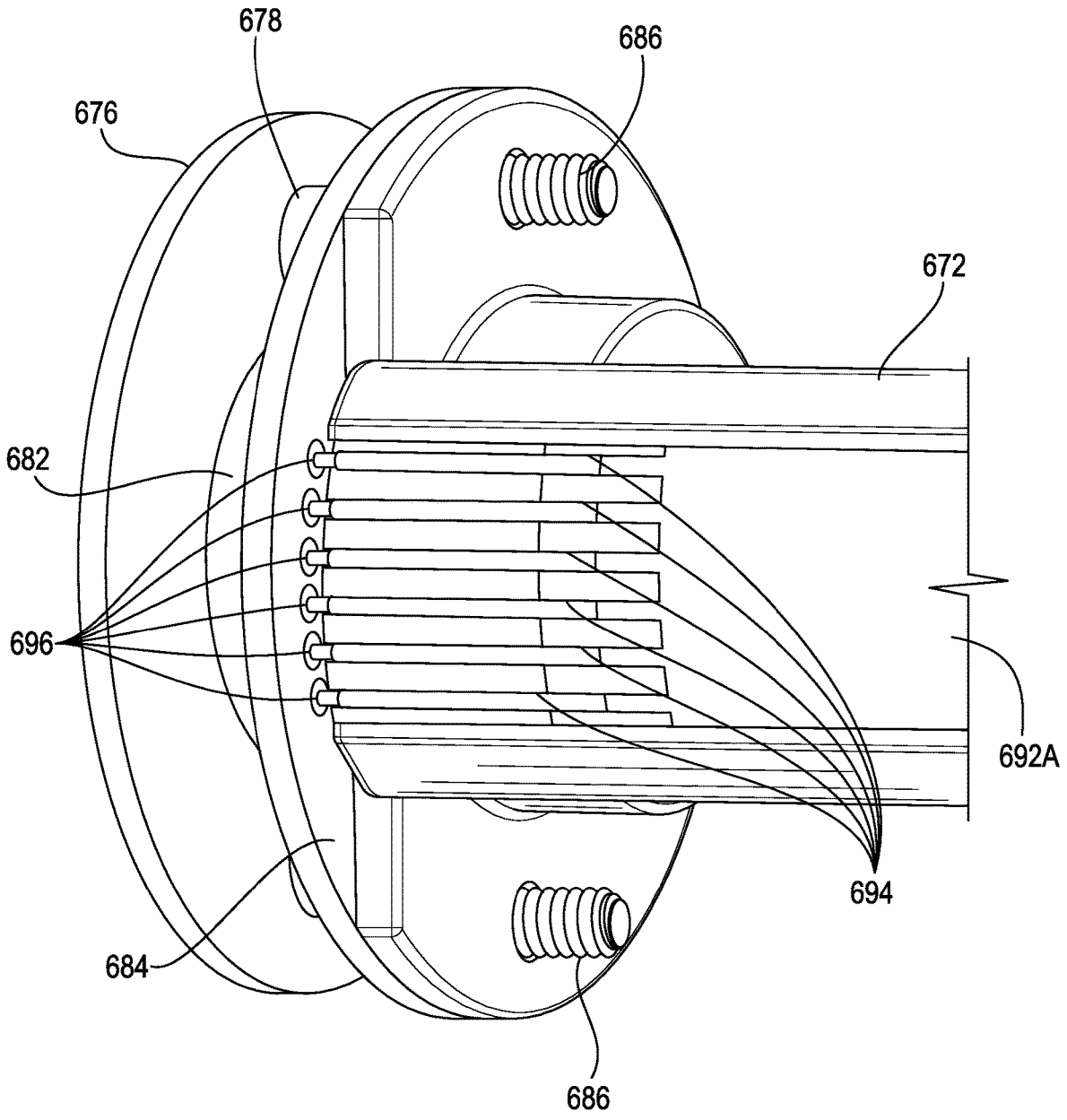
FIG. 34 is an enlarged perspective view of the pogo pin interface between the cage flex circuit and the main processor circuit board.

The LED 610 is concentrically mounted on a forward surface of a first circuit board 676 which secured to the reflector cup assembly 674 by two fasteners 678 (See FIG. 34). The rearward surface of the first circuit board has only two contact pads 680, 682 for positive and negative power (see FIG. 32). The center pad 680 is axially located and the outer ring pad 682 is concentric. This simplifies alignment during assembly.

A second, or main processor circuit board 684, has a rearward surface secured to housing 614 with two fasteners 686. The two fasteners 686 pass through contact pads (not shown) on the board 684 picking up power from the metal housing 614 and feeding it to the circuit board 684 to complete a power circuit from the positive end of the battery 612 to the board 684. The main board 684 also includes a spring-loaded negative battery terminal contact 688 which is axially guided by the forward end of the cage 672. When the battery 612 is installed, the negative battery terminal makes contact and completes the negative circuit from the battery 612 to the board 684. Power is passed from the main board 684 to the first board 676 by concentrically spaced spring-loaded pins 690 extending from a forward surface of the main board 684 which engage the concentric contact pads 680, 682 on the first circuit board 676.

The apparatus further includes an L-shaped flex circuit 692 having a main portion 692A extending along the length of the cage 672 from the tail end to the head end of the housing 614 and a leg portion 692B which wraps around the cage 672 at the tail end thereof. The magneto resistive sensors 646 are mounted to the leg portion 692B of flex circuit 692 where they are circumferentially spaced about the cage 672 each separated by about 90 degrees of rotation. As noted above, the dial 652 includes an internal magnet 658 operable to selectively activate a respective one of the sensors 646 when rotatably aligned therewith. Accessory electrical contacts 606A, 606B described above engage contact pads (not shown) on the main body 692A of the flex circuit. At the head or forward end of the main portion of the flex circuit 692 there are six (6) pogo pin connectors 694 (best seen in FIG. 34) which connect the flex circuit 692 to corresponding contact pads 696 on the rear surface of the main circuit board 684. Circuit traces (not shown) connect the 4 sensors 646 and the 2 switch contacts 606 with the pogo pins 694 to provide input signals to the circuit as generated from magneto resistive sensors 646 and the dome switch 624.

When the electronic weapon accessory 602 and mount 604 are secured in assembled relation (FIGS. 19-20), the accessory electrical contacts 606 physically and electrically engage the mount electrical contacts 608 to provide a completed electronic control circuit and provide integrated control and operation of the electronic accessory 602 with the switch 624 on the mount 604 and cooperating with the magneto resistive sensors 646 controlled by the dial 652 at the rear of the housing 614.

Turning to FIGS. 35-51, a still further exemplary embodiment is generally indicated at 700.

The outer physical configuration of the present accessory system 700 may be generally the same as the earlier embodiment 600 shown in FIGS. 19-35. However, the mount body is modified to provide an angled configuration which positions the switch at an ideal location for actuation by the user.

Figure 44:
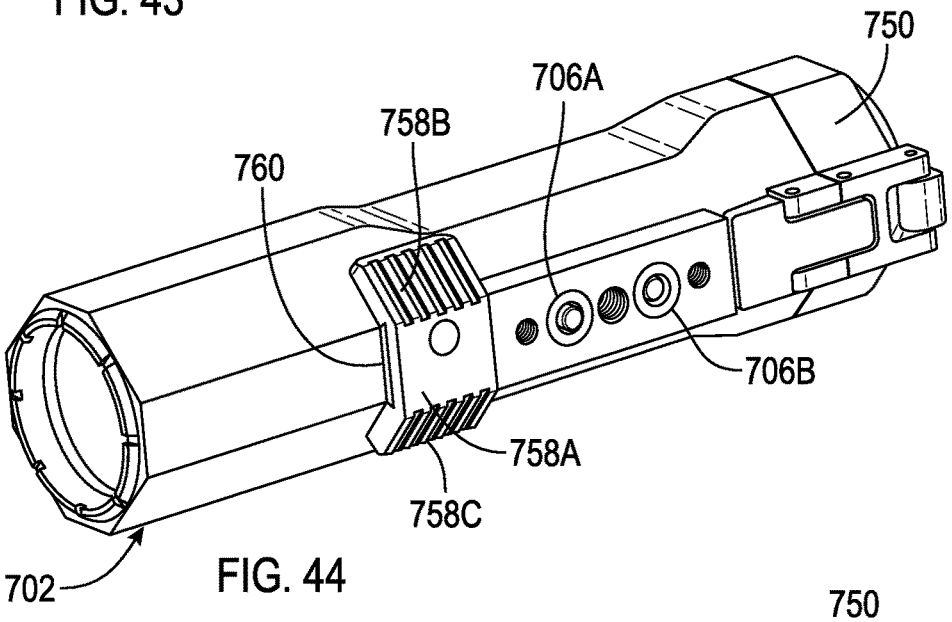
FIGS. 44-45 are perspective views showing operation of a slide switch on the side surface.
Figure 48:
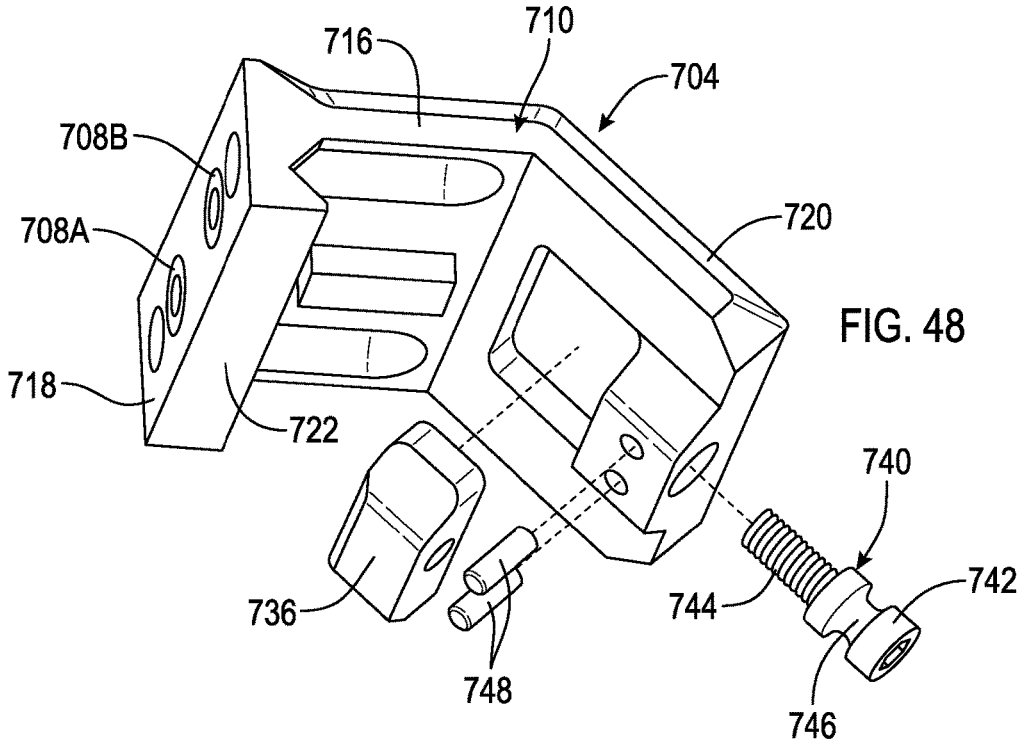
FIG. 48 is a bottom perspective view thereof.
Figure 49:
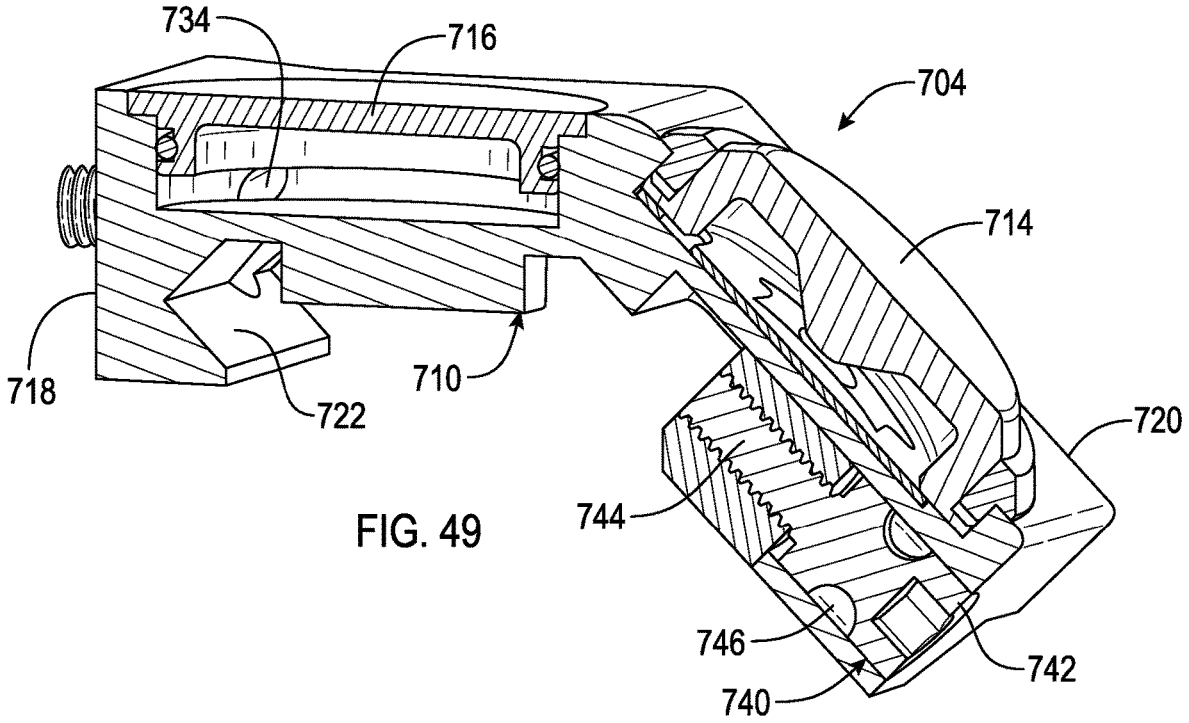
FIG. 49 is a cross-sectional view thereof taken along line 49-49 of FIG. 46.

Weapon accessory system 700 includes an electronic weapon accessory 702, such as a flashlight as illustrated, and a detachable mount 704 for the accessory, which both still have mating electrical contacts 706A, 706B and 708A, 708B at the mechanical interface between the two components (See FIGS. 44 and 48).

As described above, the detachable mount 704 includes integrated control apparatus that is external to the accessory 702. The detachable mount 704 can be removed, and/or reversed to provide a variety of mounting and control configurations or can be entirely replaced with a differently shaped or configured mount with a different switching and/or control interface (see FIG. 42 for reversed mounting configuration).

The mount 704 is also configured as previously described for attachment to a MIL-STD 1913 dovetail attachment rail or rail system 16, although other rail configurations are contemplated. The mount 704 in the present configuration is angled for an improved operational location of the switch.

Figure 46:
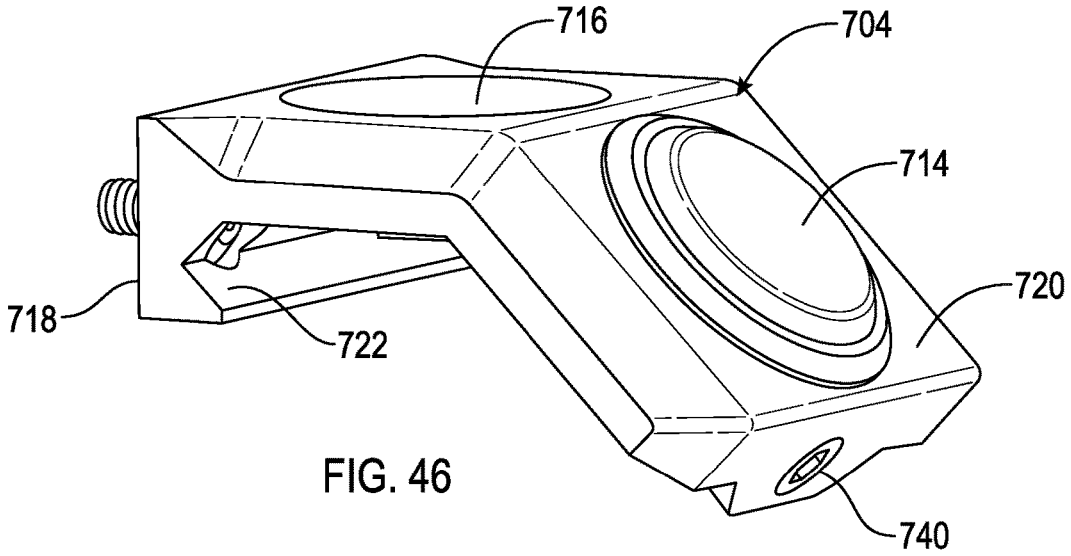
FIG. 46 is a perspective view of the mount.
Figure 47:
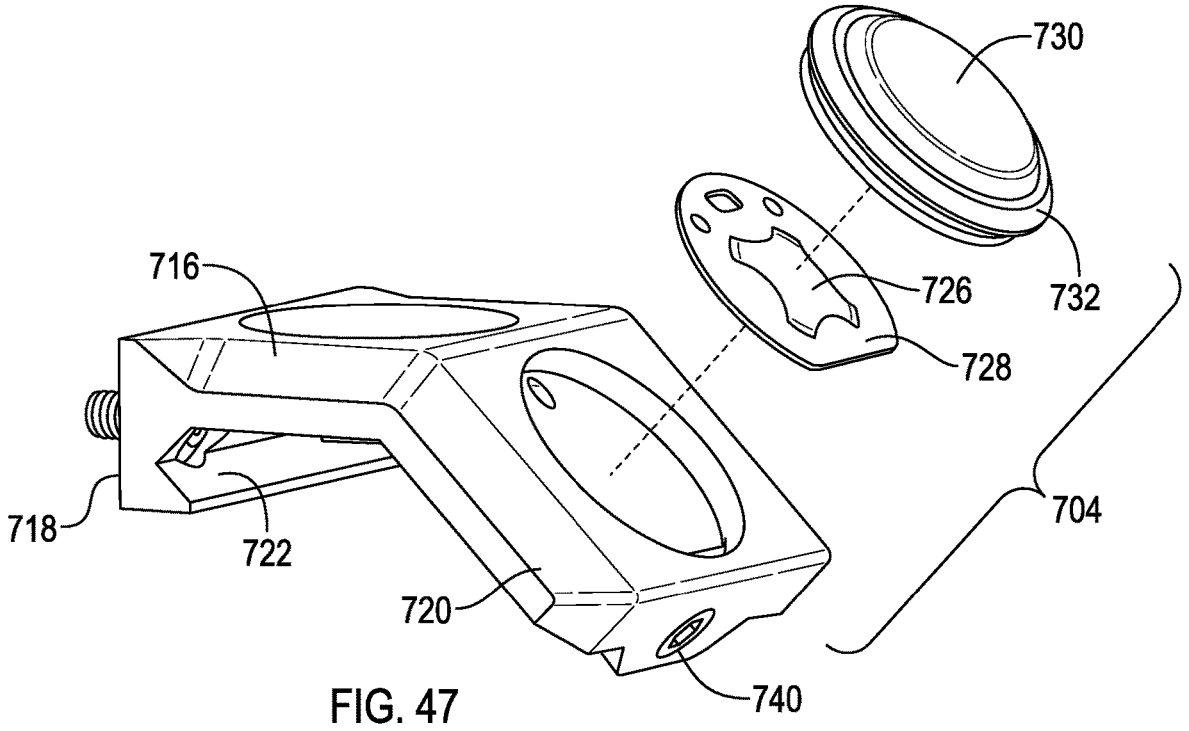
FIG. 47 is an exploded perspective view thereof.

The mount 704 generally includes a mount body 710, a clamping mechanism 712 and a switch 714 disposed within the mount body 710. The mount body 710 comprises a first portion 716 having an accessory mating surface 718 on one side thereof and a second portion 720 which extends outwardly and downwardly at an angle from the opposing side of the first portion 716. Similar to the earlier embodiments, the first portion 716 extends perpendicular from the mating surface 718. In order to provide a more optimal switch location generally between dovetail rails on a conventional rifle rail (see FIG. 1), the second portion 720 is angled at 45 degrees from the first portion. While other angles are within the scope of the invention, this 45 degree angle allows the second portion 720 to follow the exterior contour of a conventional 4-sided handguard rail structure as commonly seen in the industry. The mount 704 further includes a fixed dovetail rail clamp edge 722 on a lower surface of the first portion adjacent the accessory mating surface 718. A movable clamp element 724 is located on the lower surface of the second portion 720 of the mount body 710. The switch 714 is disposed on the upper surface of the mount body 710 and may preferably be located on the upper surface of the second angled portion 720. Referring to FIGS. 46-47, the switch 714 may be a dome switch 726 mounted on a circuit board 728 which is disposed within mount body 710. An elastomeric cover 730 is retained in place by a press fit ring 732. The switch assembly 714 is similar to that described above and the electrical contacts 708 exposed on the mating surface 718 of the mount body 710 are connected to the switch 714 through the circuit board 728 as generally described hereinabove. The routes of the connecting wires (not shown) extend from the contacts 708 through vias 734 in the mount body 710 to the circuit board 728.

As described in the previous embodiments, fasteners (not shown here) extend through the accessory mating surface 718 and removably secure the mount body 710 and accessory housing 736 in assembled relation.

Figure 37:
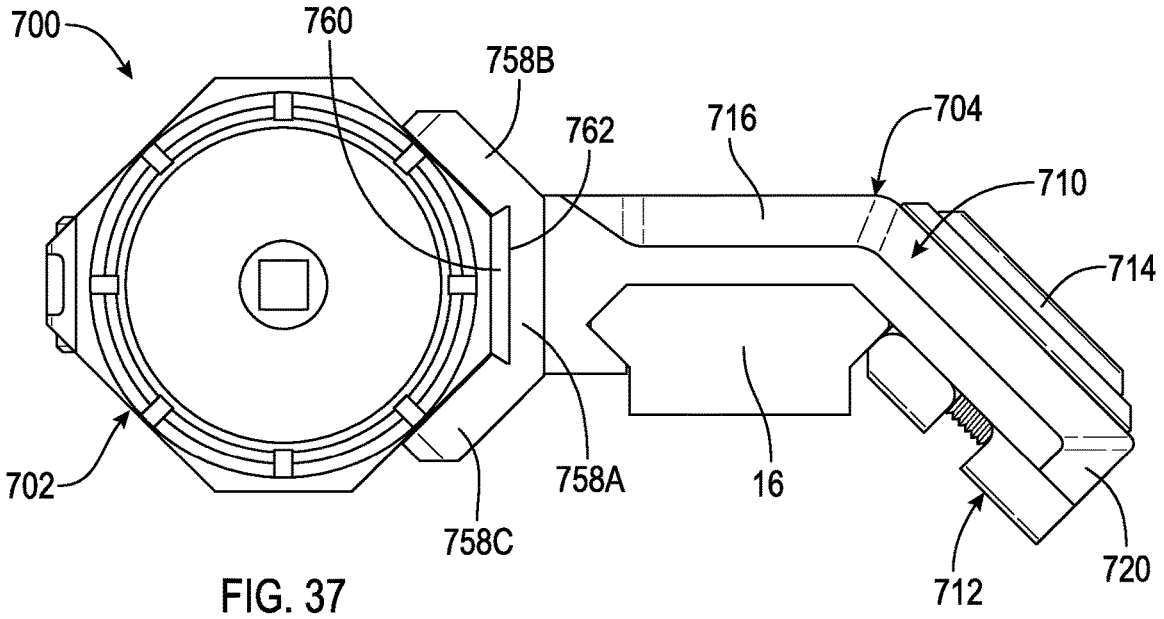
FIG. 37 is a front view thereof
Figure 38:
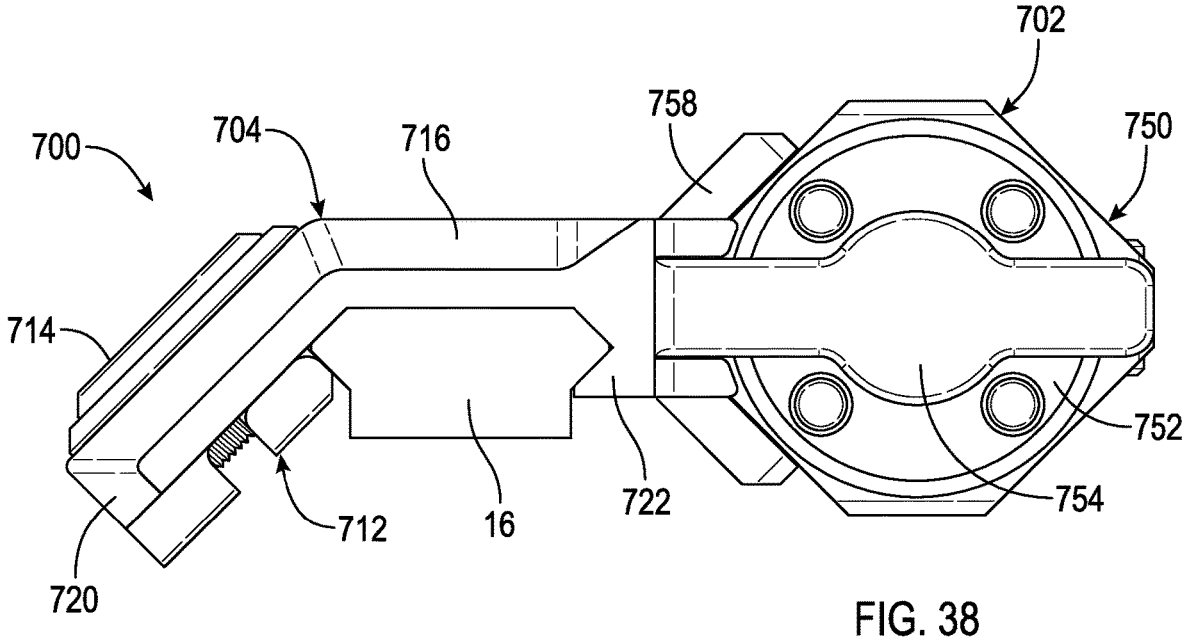
FIG. 38 is a rear view thereof.
Figure 39:
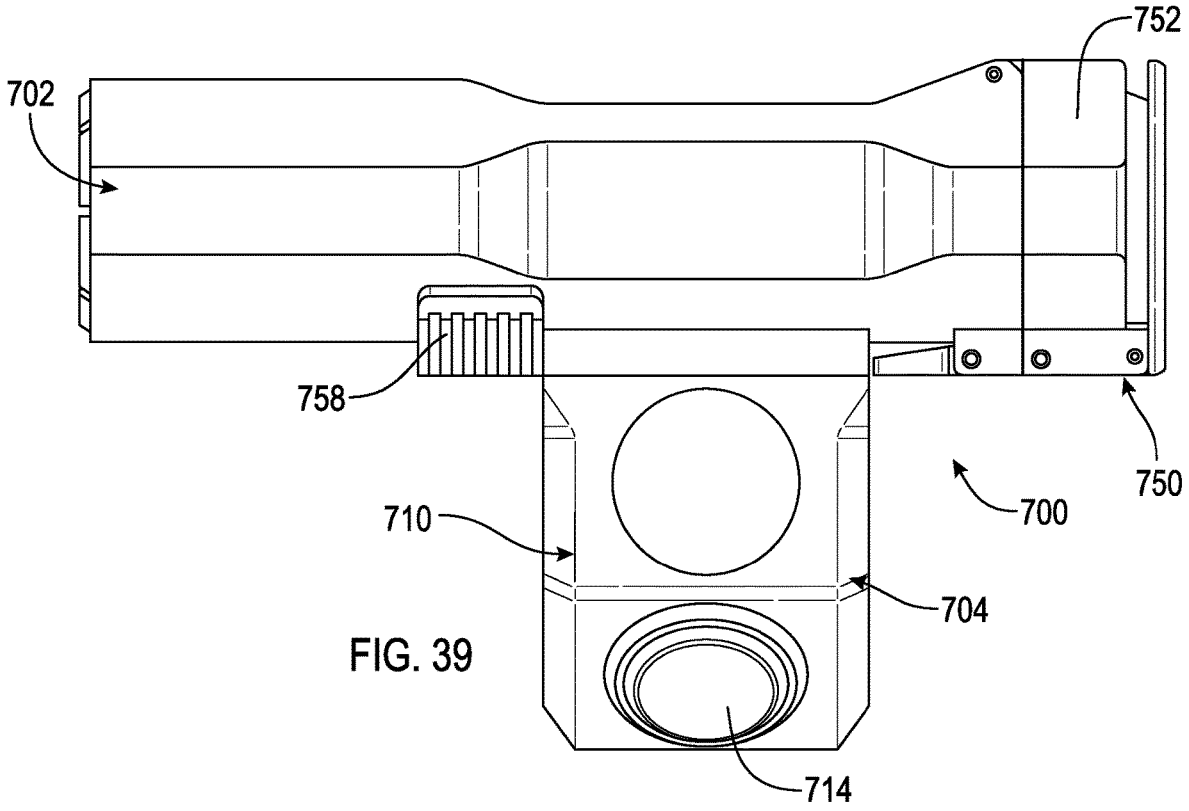
FIG. 39 is a top view thereof.
Figure 40:
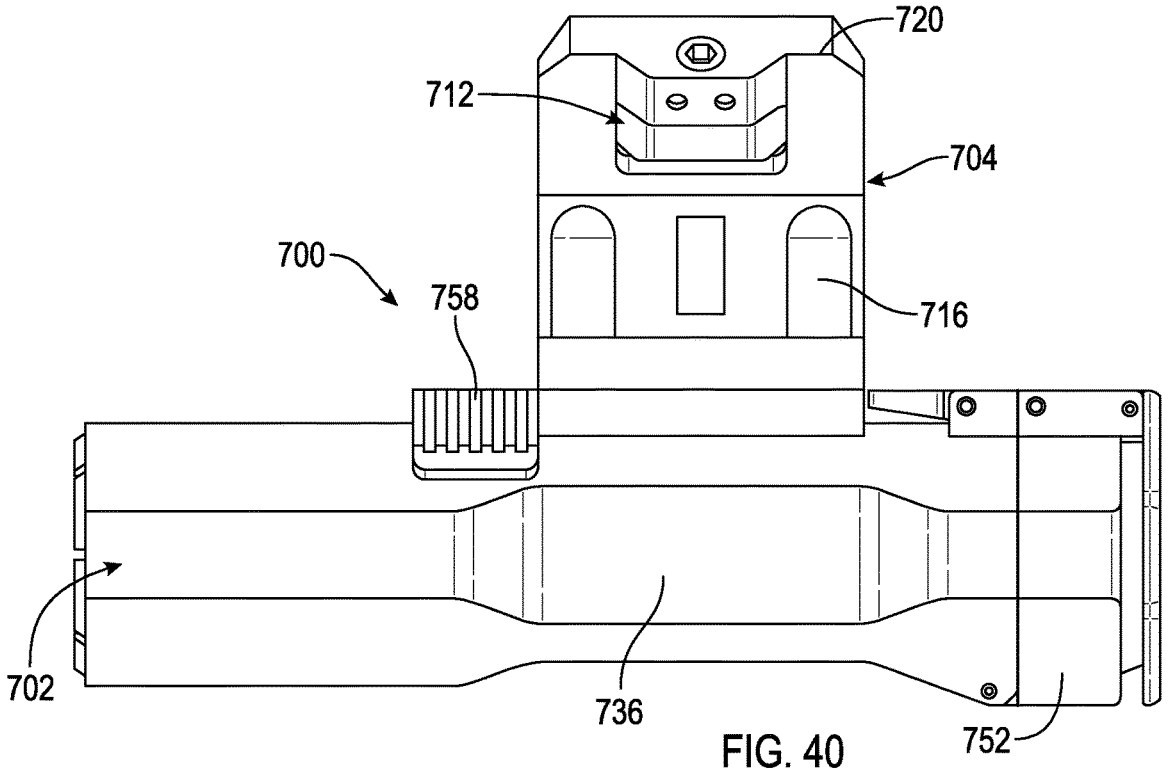
FIG. 40 is a bottom view thereof.
Figure 41:
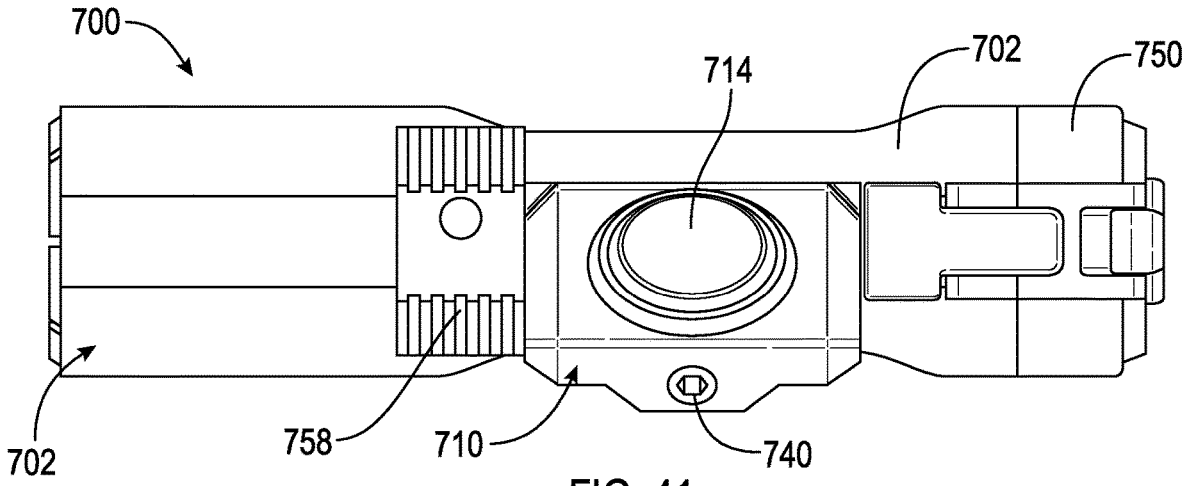
FIG. 41 is a right side view thereof.
Figure 42:
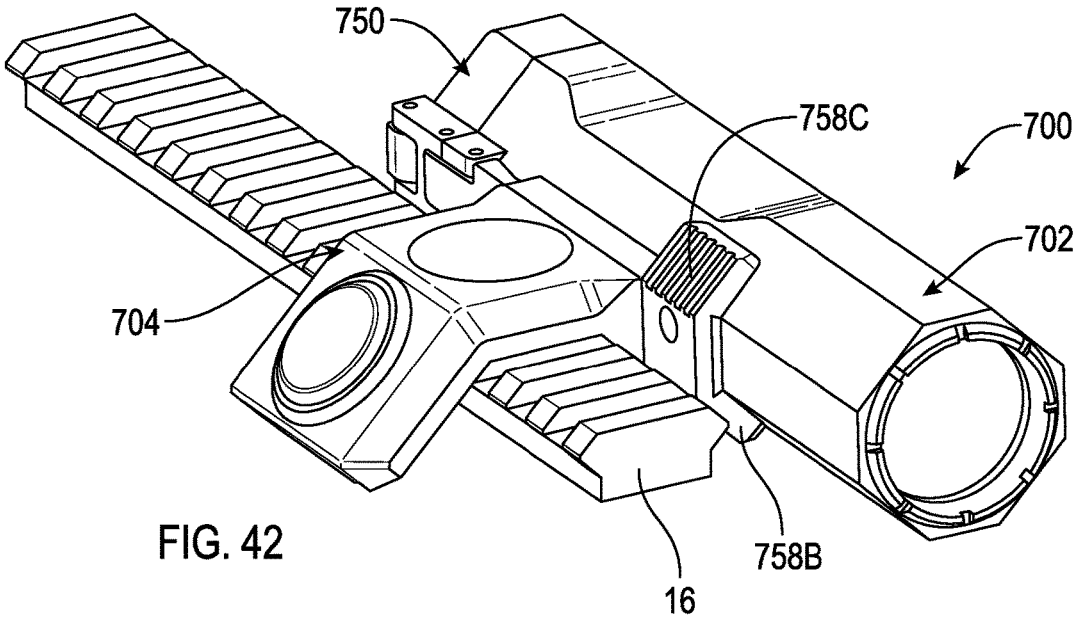
FIG. 42 is another perspective view thereof with the mount reversed for left-handed operation.
Figure 50:
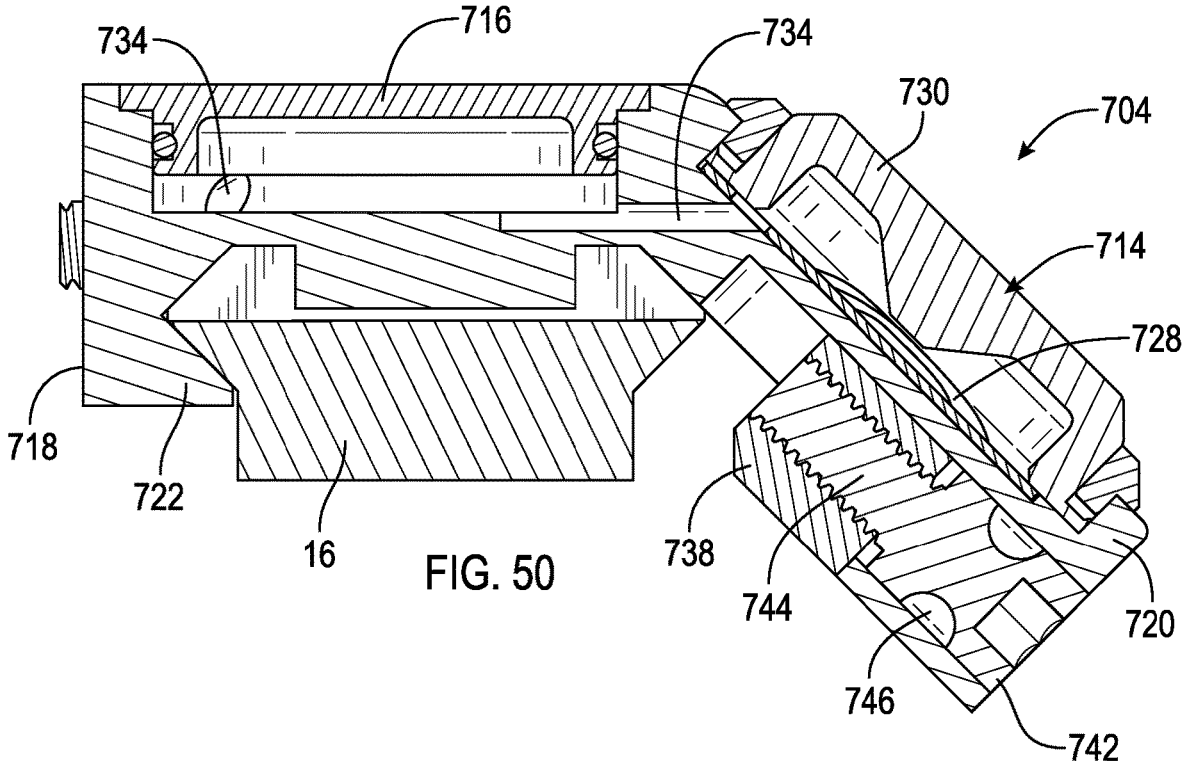
FIGS. 50-51 are cross-sectional views showing threaded movement of the clamp body into engagement with the dovetail rail.
Figure 51:
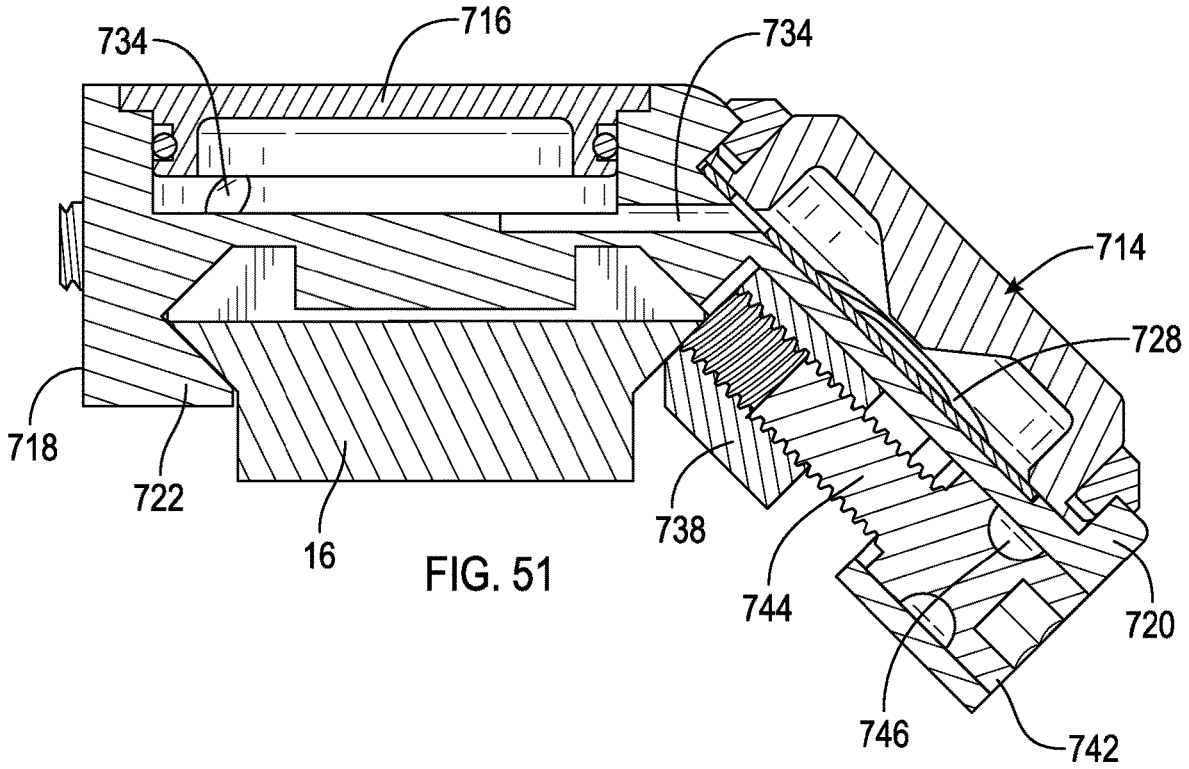
Figure 52:
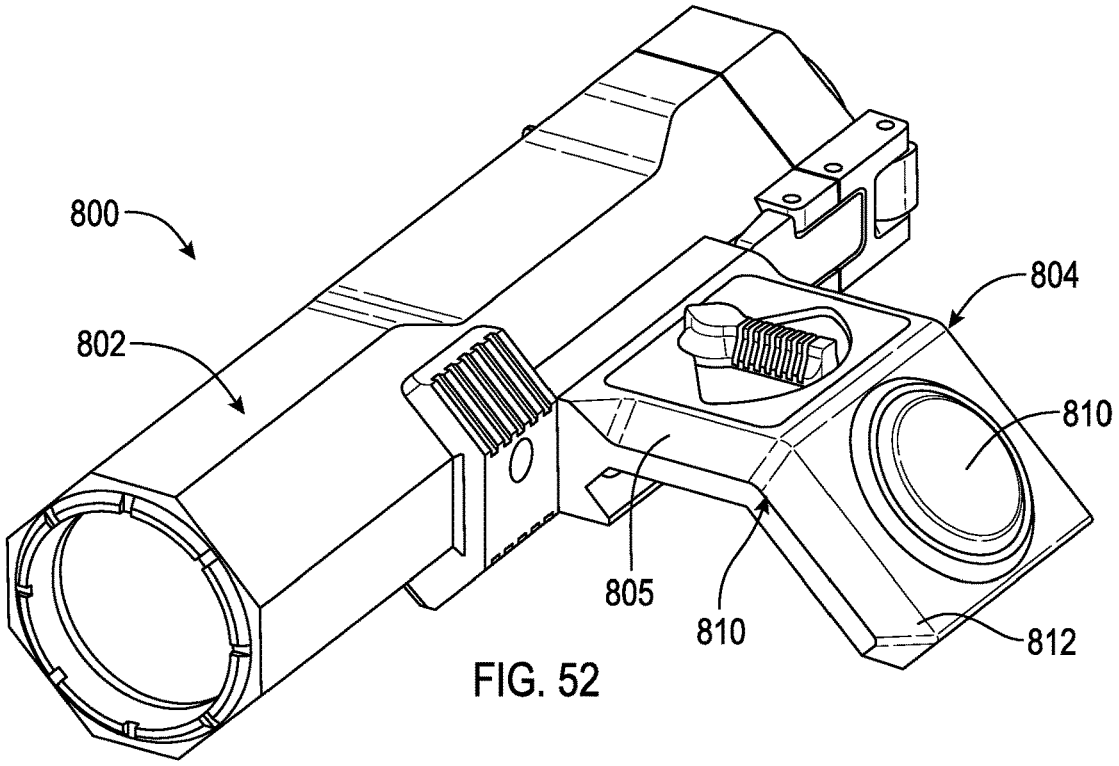
FIG. 52 is a perspective view of yet a further exemplary embodiment including a second lever switch on the mount body.
Figure 53:
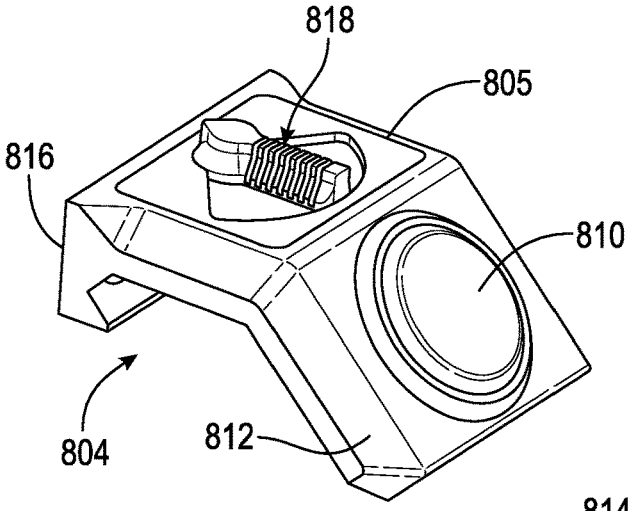
FIG. 53 is a perspective view of the mount.
Figure 54:
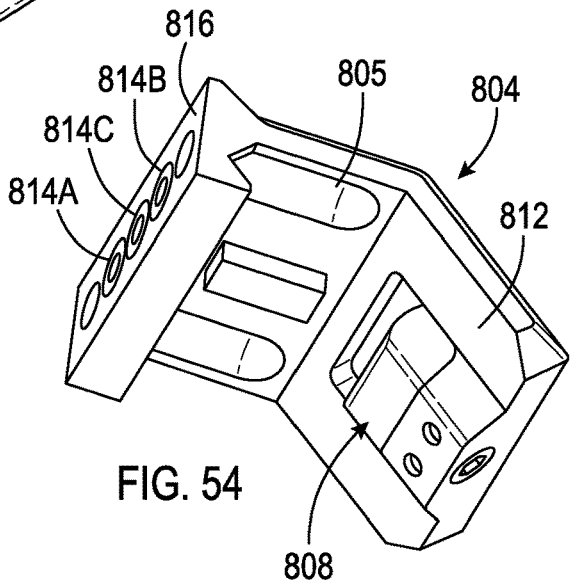
FIG. 54 is a bottom perspective view thereof.

As best illustrated in FIGS. 37-38 and 48-52, the movable clamp element 724 includes clamp body 738 and a rotatable threaded actuator 740 for movement of the clamp body 738 between an unclamped position (FIGS. 49 and 50) and a clamped position (FIGS. 37-38 and 51). The rotatable threaded actuator 740 is rotatably captured within the second portion 720 of the mount body 710 adjacent a terminal end thereof and has a head portion 742 exposed on a terminal end surface thereof (see FIGS. 46-48). The rotatable threaded actuator 740 further has a threaded shank portion 744 threadedly received within the clamp body 738. As seen in FIGS. 50-51, rotation of the actuator 740 moves the clamp body 738 into engagement with the dovetail rail 16 for mounting. Because of the angled configuration of the second portion 720 of the mount body 710 the exposed head 742 of the actuator 740 is fully accessible on the terminal end surface when assembled with any one of the dovetail rails on a conventional cylindrical or octagonal handguard. The rotatable threaded actuator 740 and clamp body 738 may be reverse threaded so that clockwise rotation of the actuator head 742 (commonly associated with tightening of a screw), moves the clamp body 738 away from the mount and tightens the clamp body 738 against the dovetail rail.

To provide captivated rotation of the actuator 740, the rotatable threaded actuator 740 includes a circumferential groove 746 adjacent to the head portion 742 and the actuator 740 is rotatably captured by opposing pins 748 received in the mount body 710 and extending through the groove 746 transverse to the actuator axis.

As described above, the accessory 702 may include an electronic component, such as an LED, and a battery power source disposed within a metal housing 736. Also as indicated above, the accessory 702 may comprise any electronic device mountable on a weapon platform, including LED lights, IR illuminators, lasers, range finders, etc. and in this regard, the accessory 702 may further include an internal circuit assembly and processor components for control of the electronic component (LED).

Figure 43:
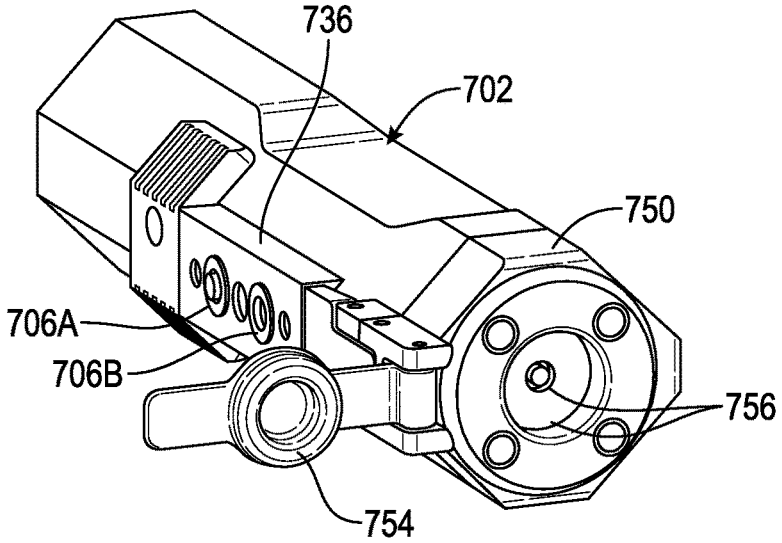
FIG. 43 is another rear view with the tail plug open.
Figure 45:
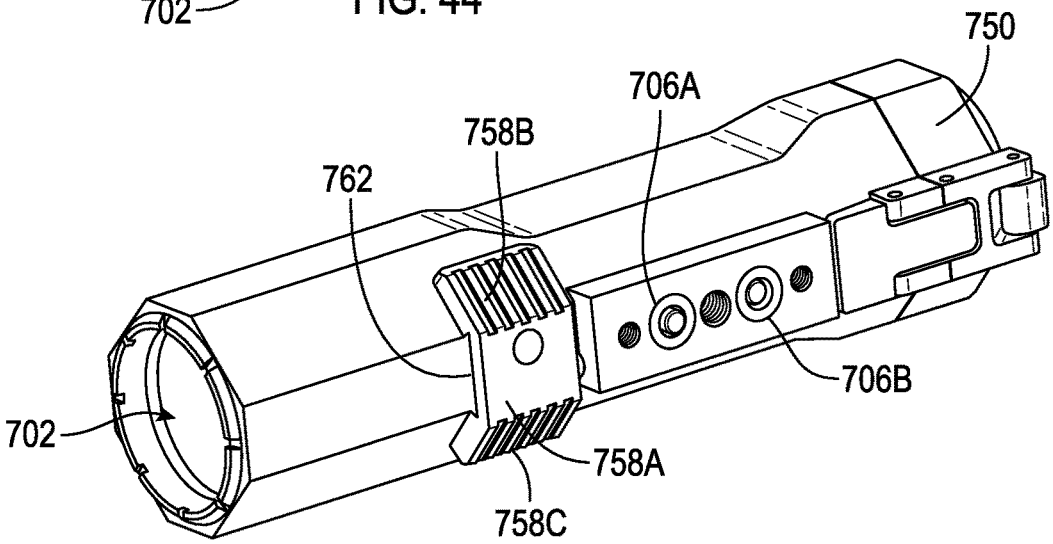

The electronic component (LED) is electrically connected to the mount 704 with electrical contacts 706A, 706B exposed on an outer surface of the housing 714 (See FIGS. 43-45). The exemplary embodiments of the contacts 706A, 706B comprise spaced, spring-loaded contact pins (pogo pins) as previously described hereinabove.

Figure 36:
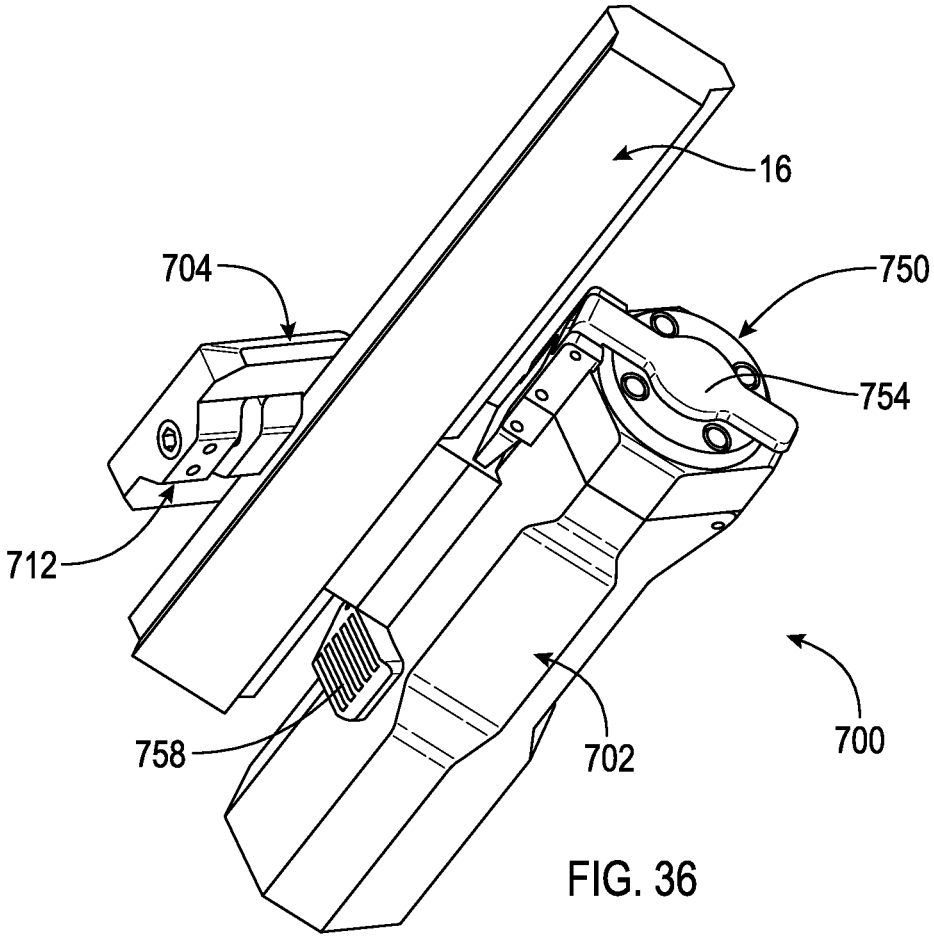
FIG. 36 is a bottom perspective view thereof.

Referring to FIGS. 36 and 43, the accessory housing 736 may have a tail cap assembly 750 including a hinge body 752 which is hinge mounted to the housing 736 at the tail end. In some cases, the end surface of the tail cap 752 may further include a hinged or tethered elastomeric plug 754 which seals a cavity containing additional input contacts 756, such as for example, to receive a snap fit or magnetic plug contact from a remote switch (now shown).

Figure 35:
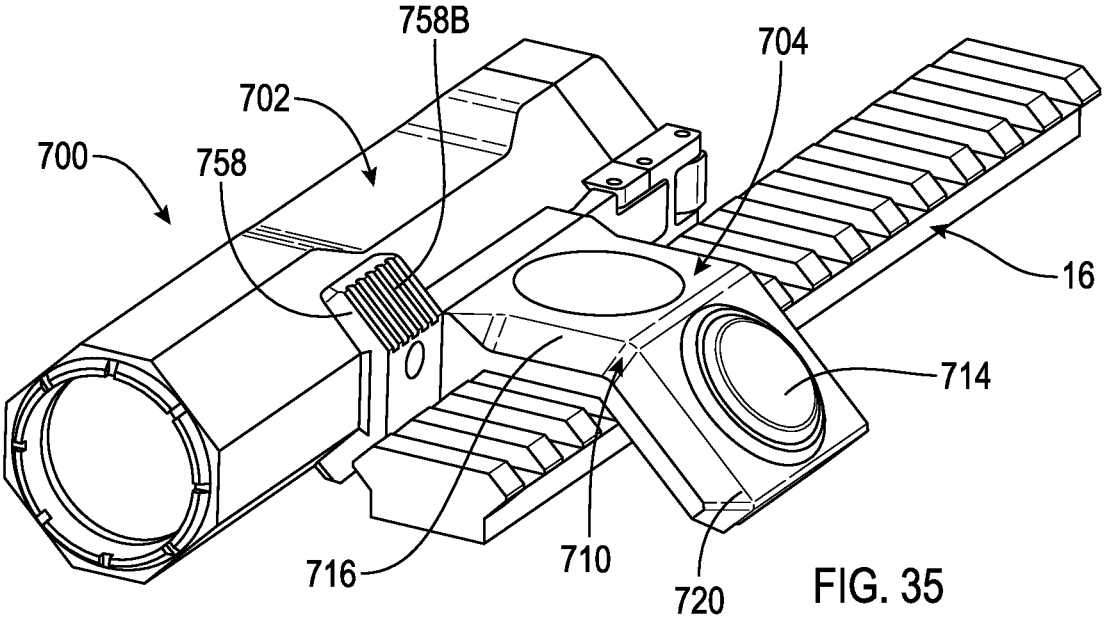
FIG. 35 is a perspective view of still another exemplary embodiment including an angled mount body.

Turning to FIGS. 44 and 45, the electronic accessory may further still have an ambidextrous slide switch 758 which extends around several of the octagonal surfaces of the accessory housing 736. The switch body 758 generally has a central portion 758A which is received on a dovetail shoulder 760 formed on the outer surface of the housing 736. A complementary dovetail slot 762 on the rear surface of the switch body 758 allows the switch body to slide longitudinally relative to the outside surface of the housing 736. The switch 758 may have various mechanical and electrical configurations to permit movement between at least two switch positions (i.e. an off position in FIG. 44 and an on (forward) position in FIG. 45). In the exemplary embodiment, the switch 758 includes a spring-loaded ball detent configuration to positively identify the switch positions, a magnet in the switch body and a hall effect sensor received on the inner flex circuit which is part of the cage assembly described hereabove. As noted, there may be alternate mechanical and electrical configurations which underlie the operation of the switch body 758. The notable feature of the switch 758 is that it is ambidextrous and includes upper and lower wing portions 758B, 758C which extend from the central body 758A. In a right-handed configuration as shown in FIG. 35 and FIGS. 44-45, the upper wing portion 758B of the slide switch 758 would be exposed and accessible adjacent to the main push button switch 714 on the mount 704. In a left-handed configuration (See FIG. 42), the lower wing portion 758C is exposed and accessible adjacent to the switch 714 on the mount 702.

FIGS. 52-56 illustrate yet another exemplary embodiment 800 of the angled mount configuration 804 with an accessory device 802. The mount 804 has generally the same construction and configuration as described above for mount 704 with the exception of an additional, or second switch on the first portion 805 of the mount body 806.

The mount 804 generally includes a mount body 806, a clamping mechanism 808 and a switch 810 disposed within the mount body 806 as described above. The primary push button switch 810 is disposed on the upper surface of the mount body 806 and may preferably be located on the upper surface of the second angled portion 814. The switch button assembly 810 is similar to that described above and the electrical contacts 814A,B exposed on the mating surface 816 of the mount body 806 are connected to the switch 810 through a circuit board also as generally described hereinabove. A second selector switch or lever switch 818 may be any desired configuration to provide an additional input for operation of the associated accessory 802. In this regard, the mount 804 includes at least one additional contact pad 814C on the accessory mating surface 816.

Figure 55:
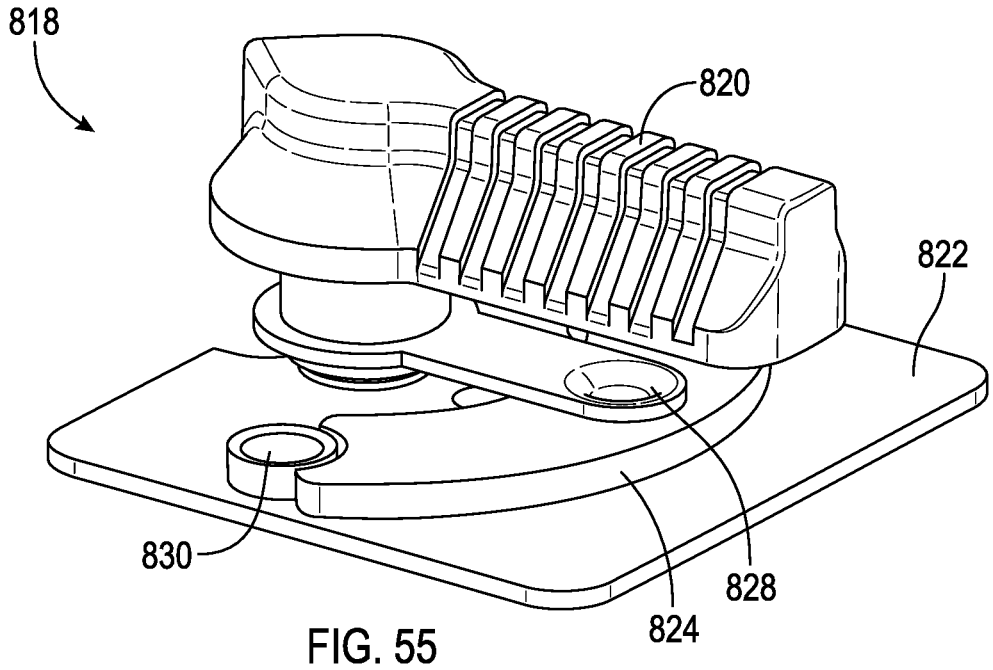
FIG. 55 is a perspective view of the lever switch assembly.
Figure 56:
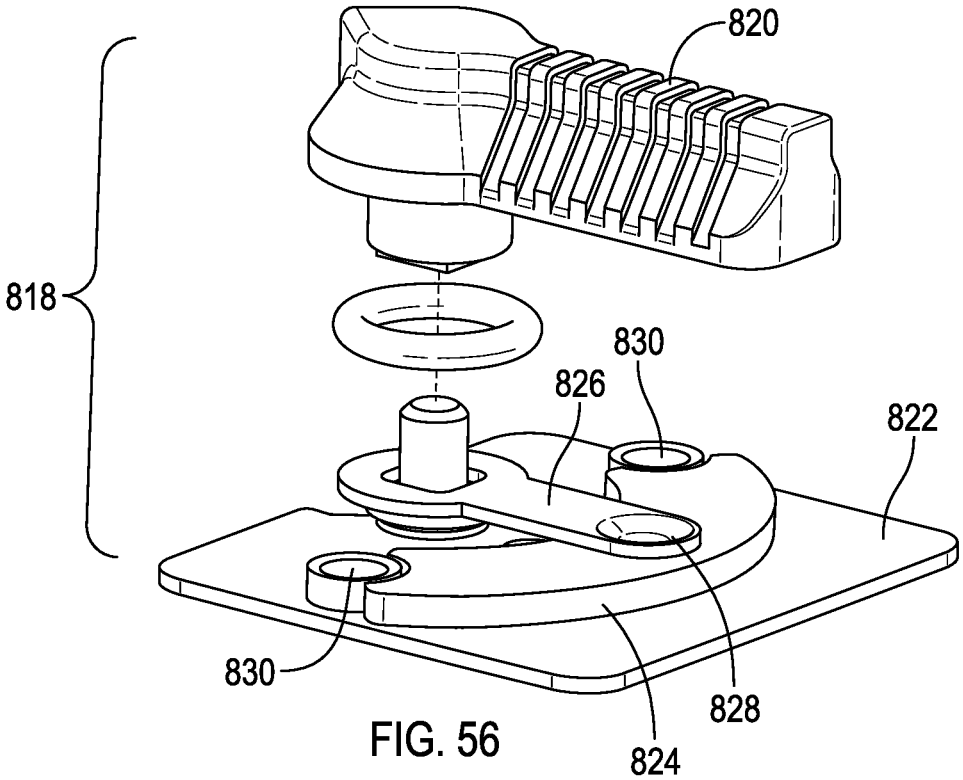
FIG. 56 is an exploded perspective view thereof.

In the illustrated exemplary embodiment, the secondary switch assembly 818 is a three-position lever switch which is rotatable between 3 different positions, i.e. a central position (See FIGS. 52-53) and two opposing positions left and right of center. FIGS. 55 and 56 are exploded views of the lever assembly 818 showing the actuator lever or handle portion 820, an underlying circuit board 822, an arcuate contact pad 824 and a rotatable contact arm 826. The contact arm 826 is keyed to the body of the lever handle 820 for rotation therewith (See square key shoulder in FIG. 56). The terminal end of the contact arm 826 includes a spherical cup or ball structure 828 which is selectively seated in a one of three detents 830 formed in the contact pad 824. The contact arm 826 is fashioned from a spring metal material to provide a spring-loaded snap detent action when moving the lever handle 820 from one position to another. The position of the arm 820 may provide an additional selector input to the internal circuit within the assembled accessory 802.

The routes of the connecting wires for both the lever switch 818 and the switch 810 extend from the contacts 814 through vias (not shown) in the mount body 806 to the lever circuit board 822 and the push button circuit board (not shown).

As described in the previous embodiments, fasteners (not shown) removably secure the mount 804 and accessory 802 in assembled relation.

The novel concept surrounding all embodiments of the invention is the removal of the mounting and control aspects of an electronic weapon accessory from the main housing of the accessory and the ability to separately adapt and customize both the mounting configuration as well as the control interface for the accessory. As indicated above, the mount and accessory are configured for reversible mounting so that the accessory can be adapted and mounted on either of the side dovetail rails of a conventional rail system or on the top or bottom rail, or on any other location of any other rail system. The exemplary embodiment locates the switch on a major outward flat face of the mount body so that the switch is presented almost flush with the rail or a space between the rails. Both of these locations are highly desirable locations which is easily operated by the users thumb while gripping the dovetail rail system on a rifle platform. However, as can be appreciated, the mount body can be contoured with other desirable shapes and the switch can be located anywhere on the body. Removing the switching and control functions from the electronic accessory allows the accessories to become smaller and more easily configured for closer mounting to the rail.

It can therefore be seen that the exemplary embodiments provide a unique and novel mounting and control solution for electronic weapon accessory.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A weapon accessory mount comprising:

a mount body comprising a first portion having an accessory mating surface on one side of said first portion, said mount body having a second portion extending outwardly and downwardly from an opposing side of said first portion;

a fixed dovetail rail clamp edge on a lower surface of said first portion of said mount body adjacent said mating surface, said second portion of said mount body having a terminal end disposed below said fixed dovetail rail clamp edge, said second portion of said mount body having an upper surface and a lower surface;

a movable clamp body slidably movable on said lower surface of said second portion of said mount body between an unclamped position adjacent said terminal end and a clamped position adjacent said first portion of said mount body;

a switch disposed on said upper surface of said mount body;

a circuit electrically connected with said switch;

said circuit having electrical contacts exposed on said mating surface of said mount body;

at least one mounting fastener extending through said accessory mating surface on said first portion of said mount body; and a threaded actuator in threaded engagement with said clamp body for movement thereof between said unclamped and clamped positions.

2. The mount of claim 1 wherein the second portion of the mount body extends outwardly and downwardly at a 45-degree angle from the first portion of the mount body.

3. The mount of claim 1 wherein the switch is disposed on the second portion of the mount body.

4. The mount of claim 1 wherein the switch is disposed on the second portion of the mount body, and further comprising a second switch disposed on the first portion of the mount body.

5. A weapon accessory apparatus comprising:

an electronic weapon accessory including a housing an external mating surface, said electronic weapon accessory having a circuit with electrical contacts exposed on said external mating surface of said housing;

a mount comprising:

a mount body comprising a first portion having an accessory mating surface on one side of said first portion, said mount body having a second portion extending outwardly and downwardly from an opposing side of said first portion;

a fixed dovetail rail clamp edge on a lower surface of said first portion of said mount body adjacent said mating surface, said second portion of said mount body having a terminal end disposed below said fixed dovetail rail clamp edge, said second portion of said mount body having an upper surface and a lower surface;

a movable clamp body slidably movable on said lower surface of said second portion of said mount body between an unclamped position adjacent said terminal end and a clamped position adjacent said first portion of said mount body;

a switch disposed on said upper surface of said mount body;

a circuit electrically connected with said switch;

said circuit having electrical contacts exposed on said mating surface of said mount body;

at least one mounting fastener extending through said accessory mating surface on said first portion of said mount body securing said mount body and said accessory housing in assembled relation; and a threaded actuator in threaded engagement with said clamp body for movement thereof between said unclamped and clamped positions.

6. The apparatus of claim 5 wherein the second portion of the mount body extends outwardly and downwardly at a 45-degree angle from the first portion of the mount body.

7. The apparatus of claim 6 wherein the switch is disposed on the second portion of the mount body.

8. The apparatus of claim 6 wherein the switch is disposed on the second portion of the mount body, and further comprising a second switch disposed on the first portion of the mount body.

9. The apparatus of claim 5 wherein said accessory electrical contacts physically and electrically engage said mount electrical contacts when in assembled relation and whereby control operation of said accessory is provided with said switch on said mount.

10. The mount of claim 5 wherein the rotatable threaded actuator is rotatably captured within said second portion of said mount body adjacent a terminal end thereof and has a head portion exposed on a terminal end surface thereof.

11. The mount of claim 10 wherein a portion of the rotatable threaded actuator adjacent said head portion includes a circumferential groove and the actuator is rotatably captured by a pin extending through said groove transverse to said actuator.

* * * * *